US012209828B2

(12) United States Patent
Mccloskey

(10) Patent No.: US 12,209,828 B2
(45) **Date of Patent: *Jan. 28, 2025**

(54) DEVICES, SYSTEMS AND METHODS FOR FACILITATING SYNCHRONIZED DISCHARGE OF FIREARMS

(71) Applicant: TRIGGER SYNC INDUSTRIES LTD., North Wiltshire (CA)

(72) Inventor: Robert Craig Mccloskey, North Wiltshire (CA)

(73) Assignee: TRIGGER SYNC INDUSTRIES LTD., North Wiltshire (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/541,826

(22) Filed: Dec. 15, 2023

(65) Prior Publication Data

US 2024/0118049 A1 Apr. 11, 2024

Related U.S. Application Data

(63) Continuation of application No. 17/777,864, filed as application No. PCT/CA2020/051596 on Nov. 24, 2020, now Pat. No. 11,892,258.

(Continued)

(51) Int. Cl.

| | |
|---|---|
| ***F41A 19/18*** | (2006.01) |
| ***F41A 19/55*** | (2006.01) |
| ***F41A 19/59*** | (2006.01) |

(52) U.S. Cl.

CPC ..... *F41A 19/183* (2013.01); *F41A 19/55* (2013.01); *F41A 19/59* (2013.01)

(58) Field of Classification Search

CPC ..... F41A 19/183; F41A 19/55; F41A 19/59

(Continued)

(56) References Cited

U.S. PATENT DOCUMENTS

| | | | |
|---|---|---|---|
| 2,046,996 | A | 7/1936 | Berdon |
| 2,071,020 | A | 2/1937 | Boussel |

(Continued)

FOREIGN PATENT DOCUMENTS

| | | | |
|---|---|---|---|
| CA | 2633003 | A1 | 7/2007 |
| CA | 2568332 | C | 10/2009 |

(Continued)

OTHER PUBLICATIONS

Wikipedia, AR-15 Style Rifle, https://en.wikipedia.org/wiki/AR-15_style_rifle, accessed on Sep. 4, 2020.

(Continued)

*Primary Examiner* — John Cooper

(74) *Attorney, Agent, or Firm* — Norton Rose Fulbright Canada LLP

(57) ABSTRACT

A firearm synchronized discharge device for facilitating a synchronized discharge of two or more firearms are described together with associated systems, firearms and methods. The device includes an actuator for engaging with a movable trigger of a first firearm, a sensor configured to generate a signal indicative of a force applied to the trigger and a first controller operatively coupled to the sensor and to the actuator. The actuator is configurable between a first configuration that prevents movement of the trigger toward a firearm-discharge position of the trigger, and a second configuration that permits movement of the trigger toward the firearm-discharge position of the trigger. When the force meets a criterion and the one or more other firearms are ready for discharge, the actuator is caused to transition from the first configuration to the second configuration to permit actuation of the trigger and discharge of the firearm.

18 Claims, 17 Drawing Sheets

Related U.S. Application Data

(60) Provisional application No. 62/940,344, filed on Nov. 26, 2019.

(58) Field of Classification Search
USPC ..... 42/1.01, 42.02, 84; 89/126, 127
See application file for complete search history.

(56) References Cited

U.S. PATENT DOCUMENTS

| | | | | |
|---|---|---|---|---|
| 2,414,914 | A * | 1/1947 | Woods | F41G 3/04 89/41.16 |
| 2,635,380 | A | 4/1953 | Baker et al. | |
| 2,948,978 | A | 8/1960 | Salverda | |
| 2,979,845 | A | 4/1961 | Christiansen, Jr. | |
| 3,324,587 | A | 6/1967 | Bryan | |
| 3,711,979 | A | 1/1973 | Small | |
| 3,713,239 | A | 1/1973 | Sperling | |
| 3,732,641 | A | 5/1973 | Adajian | |
| 3,861,069 | A | 1/1975 | Heurlen | |
| 3,978,604 | A | 9/1976 | Smith | |
| 4,205,589 | A * | 6/1980 | Engler | F41H 11/06 42/84 |
| 4,256,013 | A * | 3/1981 | Quitadama | F41G 3/04 42/84 |
| 4,718,187 | A | 1/1988 | Blake | |
| 4,825,576 | A | 5/1989 | Troncoso et al. | |
| 5,025,582 | A | 6/1991 | Mote, Sr. | |
| 5,910,002 | A | 6/1999 | Hunter | |
| 5,953,844 | A | 9/1999 | Harling et al. | |
| 6,032,396 | A | 3/2000 | Shapiro | |
| 6,237,271 | B1 | 5/2001 | Kaminski | |
| 6,257,893 | B1 * | 7/2001 | Trabut | F41A 33/00 434/11 |
| 6,499,243 | B1 | 12/2002 | Herzog | |
| 6,823,621 | B2 | 11/2004 | Gotfried | |
| 6,874,265 | B1 | 4/2005 | Pathak | |
| 7,121,464 | B2 | 10/2006 | White | |
| 7,159,500 | B2 | 1/2007 | John | |
| 7,562,479 | B2 | 7/2009 | Williams et al. | |
| 7,600,339 | B2 | 10/2009 | Schumacher et al. | |
| 7,698,846 | B2 | 4/2010 | Do Amarante et al. | |
| 8,015,741 | B2 | 9/2011 | Hooks | |
| 8,104,216 | B2 * | 1/2012 | Uhm | F41A 17/06 42/118 |
| 8,127,482 | B2 | 3/2012 | O'Shaughnessy et al. | |
| 8,141,473 | B2 | 3/2012 | Kude | |
| 8,205,372 | B2 | 6/2012 | Anzeloni | |
| 8,485,085 | B2 | 7/2013 | John | |
| 8,752,323 | B2 | 6/2014 | Fulton et al. | |
| 8,850,943 | B2 | 10/2014 | Brylev | |
| 8,893,420 | B2 | 11/2014 | Milde, Jr. et al. | |
| 8,966,803 | B2 | 3/2015 | Dietel et al. | |
| 9,074,835 | B2 | 7/2015 | Vera | |
| 9,151,559 | B2 | 10/2015 | Alicea | |
| 9,335,109 | B2 | 5/2016 | Bensayan et al. | |
| 9,441,896 | B2 * | 9/2016 | Allan | F41A 17/30 |
| 9,651,325 | B1 * | 5/2017 | Gant | F41C 23/10 |
| 2008/0092727 | A1 * | 4/2008 | Glascock | F41A 19/68 89/27.3 |
| 2014/0215882 | A1 | 8/2014 | Milde, Jr. | |
| 2014/0215883 | A1 * | 8/2014 | Milde, Jr. | G07C 9/00896 42/70.11 |
| 2015/0134087 | A1 | 5/2015 | Palmer | |
| 2015/0184967 | A1 * | 7/2015 | Whittington | F41A 19/00 42/69.01 |
| 2017/0299301 | A1 | 10/2017 | Gant et al. | |
| 2018/0224231 | A1 * | 8/2018 | Weinberg | F41A 17/38 |
| 2020/0011628 | A1 | 1/2020 | Gant et al. | |

FOREIGN PATENT DOCUMENTS

| | | | | |
|---|---|---|---|---|
| DE | 102011107950 | A1 | 1/2013 | |
| FR | 2331833 | A1 | 6/1977 | |
| FR | 2564187 | A1 | 5/1984 | |
| FR | 2836990 | A1 * | 9/2003 | F41A 19/68 |
| WO | WO-2012138242 | A1 * | 10/2012 | F41A 19/08 |
| WO | WO-2014125471 | A1 * | 8/2014 | F41A 19/58 |
| WO | 2017105603 | A1 | 6/2017 | |

OTHER PUBLICATIONS

International Searching Authority, International Search Report and Written Opinion re. international patent application No. PCT/CA2020/051596 dated May 17, 2021.

European Patent Office, Communication re. extended European search report for European patent application No. 20892826.7, Nov. 14, 2023.

* cited by examiner

| USER ACTION | DEVICE STATE | LED STATE |
|---|---|---|
| --- | OFF | OFF |
| **Device Initialization** | | |
| press power button for 1 second and release | ON | solid purple |
| press sync button | return ram behind trigger + initiate synchronizing function | flashing red and blue |
| hold sync button | continuing synchronizing function | flashing red and blue<br><br>solid green when synchronizing function is completed and firearms are paired |
| release sync button | sync function completed | solid green |
| **Rifles Ready for Synchronized Firing Sequence** | | |
| shooter(s) of other synchronized firearms has reached PPWV | waiting for current shooter to apply PPWV | solid yellow |
| shooter of current firearm has reached PPWV | waiting for other shooter(s) to apply PPWV | solid red |
| **Synchronized Firing of Firearms** | | |
| --- | ON | solid purple |
| press power button for 1 second and release | OFF | OFF |

FIG. 17

DEVICES, SYSTEMS AND METHODS FOR FACILITATING SYNCHRONIZED DISCHARGE OF FIREARMS

CROSS REFERENCE TO RELATED APPLICATIONS AND CLAIM OF PRIORITY

The present application is a continuation of U.S. patent application Ser. No. 17/777,864 filed on May 18, 2022 and incorporated herein by reference, which is a national phase application under 35 U.S.C. 371 of International Patent Application No. PCT/CA2020/051596 filed on Nov. 24, 2020 and incorporated herein by reference, which claims priority to U.S. provisional patent application No. 62/940,344 filed on Nov. 26, 2019, the entire contents of which are hereby incorporated herein by reference.

TECHNICAL FIELD

The disclosure relates generally to firearms, and more particularly to devices and methods allowing the synchronized discharge of firearms.

BACKGROUND

There are situations such as hunting where the simultaneous discharge of two or more firearms toward one or more targets can be of value. Achieving simultaneous discharge of firearms while still achieving a high level of accuracy can be challenging even if the hunters can communicate visually or with the use of voice commands, which is not conducive in most hunting situations even when hunters are in close proximity to one another. Achieving good marksmanship usually requires gently squeezing the trigger while holding the firearm on the target. However, the hunters may not actually know the precise moment when their respective firearms will be discharged while gently squeezing the trigger and gradually increasing the force applied to the trigger. The firearm will usually only discharge once the hunter has applied the trigger pull weight required to cause the discharge.

When attempting the simultaneous discharge of firearms, usually only the first shooter will get a good shot since the second shooter becomes affected by the noise of the first shot. This situation is not conducive to the second shooter producing an accurate second shot, and may require the second shooter to make a rushed shot or reset his firing procedure from the beginning an thereby delaying the second shot further. In addition, the second shooter must also deal with the target's reaction to the first shooter's shot. In a hunting scenario, this would usually mean the immediate evacuation of the area by the animal(s) being hunted and leaving the second shooter aiming at a moving target. The second shooter must then attempt to make a rushed shot at a further distance from the target before the target gets out of range or makes cover. Improvement is desirable.

SUMMARY

In one aspect, the disclosure describes a firearm synchronized discharge device for facilitating a synchronized discharge of two or more firearms. The device comprises:

an actuator for engaging with a movable trigger of a first firearm, the actuator configurable between a first configuration that prevents movement of the trigger toward a firearm-discharge position of the trigger, and a second configuration that permits movement of the trigger toward the firearm-discharge position of the trigger;

a sensor configured to generate a signal indicative of a force applied to the trigger by a shooter; and a controller operatively coupled to the sensor and to the actuator, the controller configured to: receive data indicative of one or more states of one or more respective other firearms; and when the force meets a criterion and the one or more states indicate that the one or more other firearms are ready for discharge, cause the actuator to transition from the first configuration to the second configuration to permit movement of the trigger toward the firearm-discharge position of the trigger.

The actuator may be a hydraulic actuator for interacting with hydraulic fluid. The sensor may be a pressure sensor for sensing a pressure of the hydraulic fluid.

The actuator may include a ram for engaging with a back side of the trigger.

The device may comprise a trigger guard where a rear end of the trigger guard is slotted to provide a passage for the ram.

The device may comprise a valve operatively coupled to the controller for selectively stopping and permitting a flow of the hydraulic fluid out of a chamber of the hydraulic actuator.

The device may comprise a reservoir coupled for fluid communication with the hydraulic actuator via the valve. The reservoir may include a piston movable in a first direction when receiving hydraulic fluid in the reservoir, and movable in a second direction when delivering the hydraulic fluid out of the reservoir and toward the hydraulic actuator.

The piston may be operatively coupled to a manual push button for causing movement of the piston in the second direction when the push button is depressed.

The device may comprise a pistol grip housing the actuator, and an adaptor block releasably attachable to a pistol grip interface of the first firearm. The pistol grip may be releasably attachable to the pistol grip interface via the adaptor block.

The device may comprise a pistol grip for the first firearm. The actuator, the sensor and the controller may be housed inside the pistol grip.

The device may comprise one or more user input devices operatively coupled to the controller. The one or more user input devices may be disposed on the pistol grip.

The device may comprise a visual indicator operatively coupled to the controller and configured to indicate a state of the device.

The visual indicator may be attachable to a Picatinny rail of the first firearm.

The visual indicator may include a light-emitting diode. An output color of the light-emitting diode may be indicative of the state of the device.

The criterion may include the force being equal to or exceeding a predetermined pull weight value greater than a trigger pull weight value of the first firearm.

The device may comprise a readout indicating the predetermined pull weight value.

The actuator may be a hydraulic actuator.

Embodiments may include combinations of the above features.

In another aspect, the disclosure describes a pistol grip for a firearm. The pistol grip comprises:

a shell;

an actuator for engaging with a movable trigger of a firearm, the actuator configurable between a first configuration that prevents movement of the trigger toward a firearm-discharge position of the trigger, and a second configuration that permits movement of the trigger toward the firearm-discharge position of the trigger, the actuator being housed by the shell;

a sensor configured to generate a signal indicative of a force applied to the trigger by a shooter; and a controller operatively coupled to the sensor and to the actuator, the first controller configured to: receive data indicative of one or more states of one or more respective other firearms; and when the force is equal to or exceeds a predetermined pull weight value greater than a trigger pull weight value of the firearm, and the one or more states indicate that the one or more other firearms are ready for discharge, cause the actuator to transition from the first configuration to the second configuration to permit movement of the trigger toward the firearm-discharge position of the trigger.

The sensor and the controller may be housed by the shell.

The pistol grip may comprise one or more user input devices disposed on the shell and operatively coupled to the controller.

The actuator may include a ram for engaging with a back side of the trigger.

The actuator may be a hydraulic actuator.

Embodiments may include combinations of the above features.

In another aspect, the disclosure describes a kit comprising:

a pistol grip; and a trigger guard, a rear end of the trigger guard being slotted to provide a passage for a ram of an actuator.

The kit may include an adaptor block to facilitate the attachment of the pistol grip to a firearm.

Embodiments may include combinations of the above features.

In another aspect, the disclosure describes a system for facilitating a synchronized discharge of two firearms. The system comprises:

a first actuator for engaging with a movable first trigger of a first firearm, the first actuator configurable between a first configuration that prevents movement of the first trigger toward a firearm-discharge position of the first trigger, and a second configuration that permits movement of the first trigger toward the firearm-discharge position of the first trigger;

a first sensor configured to generate a first signal indicative of a first force applied to the first trigger by a first shooter;

a first controller operatively coupled to the first sensor and to the first actuator;

a second actuator for engaging with a movable second trigger of a second firearm, the second actuator configurable between a first configuration that prevents movement of the second trigger toward a firearm-discharge position of the second trigger, and a second configuration that permits movement of the second trigger toward the firearm-discharge position of the second trigger;

a second sensor configured to generate a second signal indicative of a second force applied to the second trigger by a second shooter;

a second controller operatively coupled to the second sensor and to the second actuator;

wherein:

the first controller and the second controller are configured for data communication with each other;

the first controller is configured to, when the first force meets a first criterion and the second force meets a second criterion, cause the first actuator to transition from the first to the second configuration of the first actuator; and the second controller is configured to, when the first force meets the first criterion and the second force meets the second criterion, cause the second actuator to transition from the first to the second configuration of the second actuator.

The first actuator may be a hydraulic actuator for interacting with hydraulic fluid. The first sensor may be a pressure sensor for sensing a pressure of the hydraulic fluid.

The first actuator may be a hydraulic actuator for interacting with hydraulic fluid. The system may include a valve for controlling a flow of the hydraulic fluid.

The system may comprise:

a pistol grip housing the first actuator; and an adaptor block releasably attachable to a pistol grip interface of the first firearm, the pistol grip being releasably attachable to the adaptor block.

The system may comprise a pistol grip of the first firearm. The first actuator, the first sensor and the first controller may be housed by the pistol grip.

The first criterion may include the first force being equal to or exceeding a first predetermined pull weight value greater than a first trigger pull weight value of the first firearm. The second criterion may include the second force being equal to or exceeding a second predetermined pull weight value greater than a second trigger pull weight value of the second firearm.

The first and second controllers may be configured for wireless communication with each other.

Embodiments may include combinations of the above features.

In another aspect, the disclosure describes a pistol-gripped firearm comprising:

a trigger movable to cause discharge of the firearm;

a pistol grip for holding the firearm by a shooter;

an actuator engageable with the movable trigger, the actuator configurable between a first configuration that prevents movement of the trigger toward a firearm-discharge position of the trigger, and a second configuration that permits movement of the trigger toward the firearm-discharge position of the trigger, the actuator being disposed inside of the pistol grip;

a sensor configured to generate a signal indicative of a force applied to the trigger by the shooter, the sensor being disposed inside the pistol grip; and a controller operatively coupled to the sensor and to the actuator, the controller being disposed inside the pistol grip and being configured to: receive data indicative of a state of a firearm other than the pistol-gripped firearm; and when the force meets a criterion and the state indicates that other firearm is ready for discharge, cause the actuator to transition from the first to the second configuration.

The actuator may include a ram engageable with a back side of the trigger.

The ram may extend between lower ears of a lower receiver of the pistol-gripped firearm.

The pistol-gripped firearm may comprise a trigger guard. The ram may extend through a passage formed in the trigger guard.

The actuator may be a hydraulic actuator.

The pistol-gripped firearm may comprise an adaptor block releasably attached to a pistol grip interface of the pistol-gripped firearm. The pistol grip may be releasably attached to the pistol grip interface via the adaptor block.

The criterion may includes the force being equal to or exceeding a predetermined pull weight value greater than a trigger pull weight value of the pistol-gripped rifle.

The pistol-gripped firearm may comprise a readout indicating the predetermined pull weight value. The readout being disposed on the pistol grip.

The pistol-gripped firearm may comprise a light-emitting diode mounted to a Picatinny rail of the firearm. An output color of the light-emitting diode may be indicative of the state of the pistol-gripped firearm.

Embodiments may include combinations of the above features.

In a further aspect, the disclosure describes a method of facilitating a synchronized discharge of firearms. The method comprises:

preventing a discharge of a first firearm by preventing an actuation of a first trigger of the first firearm to a first firearm-discharge position when a discharge of a second firearm is prevented;

monitoring a first force applied to the first trigger of the first firearm; and when the first force applied to the first trigger of the first firearm is equal to or greater than a trigger pull weight value of the first firearm and the discharge of the second firearm is permitted, substantially simultaneously permitting the discharge of the first firearm by permitting the actuation of the first trigger to the first firearm-discharge position.

The method may comprise preventing the discharge of the first firearm when the first force applied to the first trigger is lower than a first predetermined pull weight value greater than the trigger pull weight value of the first firearm.

The method may comprise preventing an actuation of a second trigger of the second firearm to a second firearm-discharge position to prevent the discharge of the second firearm.

The method may comprise monitoring a second force applied to the second trigger of the second firearm.

The discharge of the second firearm may be permitted when the second force applied to the second trigger is equal to or exceeds a trigger pull weight value of the second firearm.

The method may include permitting the discharge of the second firearm by permitting the actuation of the second trigger to the second firearm-discharge position of the second trigger.

The method may comprise preventing the actuation of the first trigger using a hydraulic actuator interacting with the first trigger by preventing a flow of hydraulic fluid out of a chamber of the hydraulic actuator.

The method may comprise permitting the actuation of the first trigger by allowing the flow of hydraulic fluid out of the chamber of the hydraulic actuator.

Before preventing the discharge of the first firearm, the method may comprise manually urging the hydraulic fluid into the chamber of the hydraulic actuator.

The method may comprise:

receiving, at the first firearm, a shooter input indicative of a message to be transmitted to a shooter of the second firearm;

transmitting a signal from the first firearm to the second firearm; and when the signal is received at the second firearm, providing an indication indicative of the message to the shooter of the second firearm.

The method may comprise:

indicating a state of the second firearm to the shooter of the second firearm using an indicator; and providing, using the indicator, the indication indicative of the message to the shooter of the second firearm.

The first and second firearms may be part of a plurality of firearms including more than two firearms. The method may comprise:

preventing a discharge of all of the firearms in the plurality of firearms;

receiving signals indicative of all the firearms of the plurality of firearms being ready to be discharged, the signals being associated with respective ready times, a last firearm of the plurality of firearms having a latest ready time; and permitting the discharge of all firearms in the plurality of firearms except for the last firearm.

The plurality of firearms may include four or more firearms.

The method may comprise monitoring forces applied to respective triggers of each firearm in the plurality of firearms, wherein each firearm in the plurality of firearms is ready to be discharged when a force applied to the trigger of each firearm is equal to or exceeds a predetermined pull weight value greater than a trigger pull weight value of the respective firearm.

Embodiments may include combinations of the above features.

Further details of these and other aspects of the subject matter of this application will be apparent from the detailed description included below and the drawings.

DESCRIPTION OF THE DRAWINGS

Reference is now made to the accompanying drawings, in which:

FIG. 17 is a table listing states of the device of FIG. 2, 11 or 13 with associated user actions and states of a visual indicator.

DETAILED DESCRIPTION

The following disclosure describes systems, devices and methods that facilitate the synchronized discharge of two or more firearms operated by respective shooters. In some embodiments, the devices described herein may facilitate synchronized discharge of firearms without altering the normal operating procedure or the safety features of the firearms. In some embodiments, the devices described herein also do not disrupt the traditional procedure of the shooter and may consequently promote good marksmanship. The devices described herein may be incorporated in various types of handheld firearms. In some embodiments, the devices may be configured as a module that may be integrated with an "AR style" rifle or other pistol-gripped firearms in a convenient and user-friendly manner.

The term "substantially" as used herein may be applied to modify any quantitative representation which could permissibly vary without resulting in a change in the basic function to which it is related. The terms "connected", "coupled to" or "engaged with" may include both direct connection/coupling/engagement (in which two elements contact each other) and indirect connection/coupling/engagement (in which at least one additional element is disposed between the two elements).

Aspects of various embodiments are described through reference to the drawings.

Figure 1:
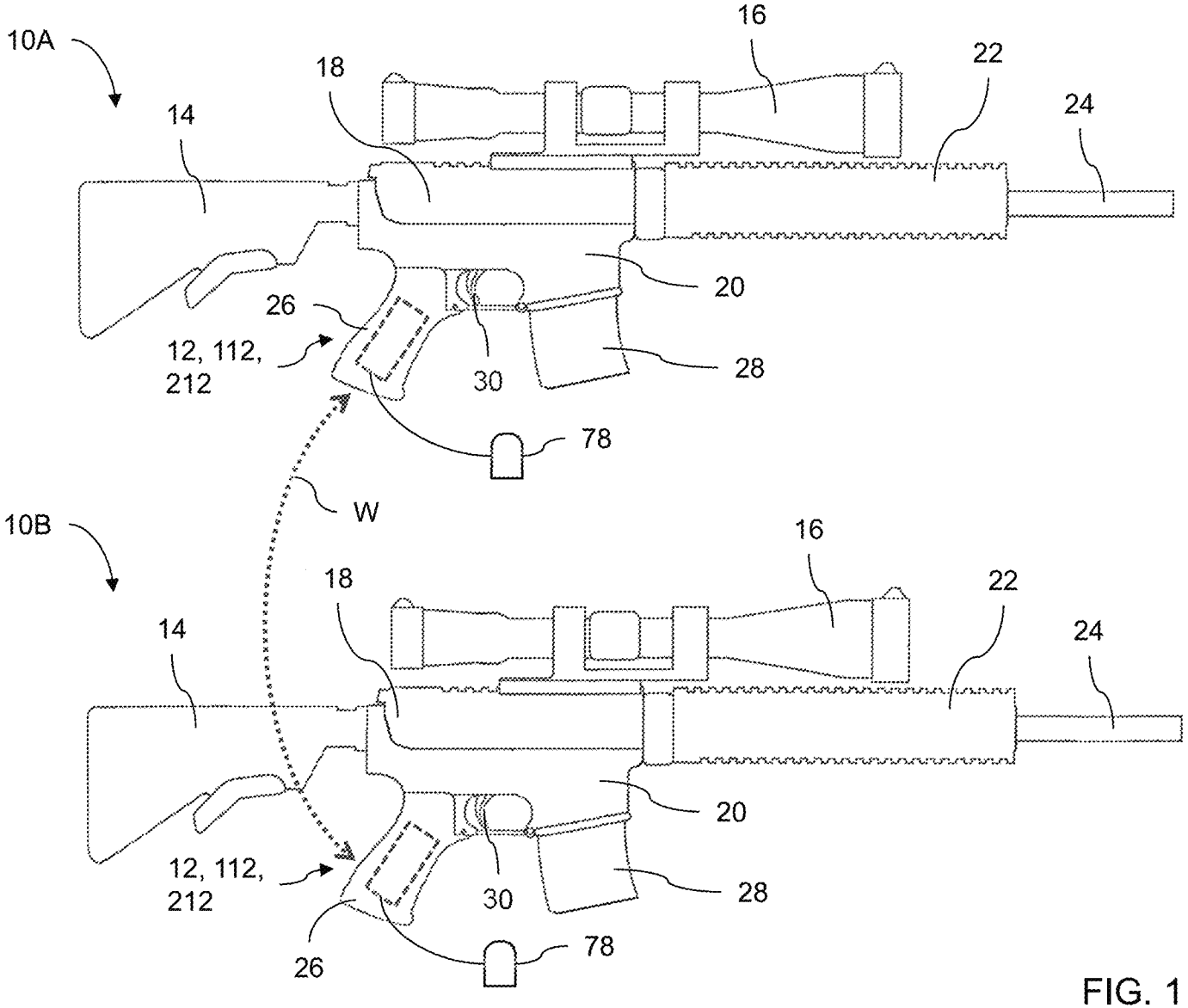
FIG. 1 is a side elevation view of two exemplary firearms each including a device for facilitating the synchronized discharge of the two firearms.

FIG. 1 is a side elevation view of two exemplary firearms 10A, 10B each including firearm synchronized discharge device 12 for facilitating the synchronized discharge of firearms 10A, 10B (referenced generically herein as "firearm 10"). Devices 12 may work together as a system for facilitating the synchronized discharge of firearms 10A, 10B. Firearms 10A, 10B as illustrated are of a type commonly known as an "AR-15 style" rifle but it is understood that device 12 may be integrated with other types of handheld firearms. An AR-15 style rifle is known as being a relatively lightweight semi-automatic civilian rifle based on the ArmaLite AR-15 design. Examples of AR-15 style rifles include model XM-15 sold under the trade name Bushmaster Firearms®, and model R-15 sold under the trade name Remington®. In some embodiments, one or both of firearms 10A, 10B may be of a type known as a "modern sporting rifle" suitable for hunting. In some embodiments, one or both of firearms 10A, 10B may be a pistol-gripped rifle. In some embodiments, firearm 10 may be an ArmaLite AR-10 rifle. Device 12 may be used with pistol-gripped firearms or with other types of firearms that can be modified to accommodate a pistol grip.

Even though FIG. 1 illustrates firearms 10A, 10B as being identical, it is understood that the two or more firearms 10A, 10B that are used together for synchronized discharge using devices 12 may be of a same type or may be of different types. In other words, device 12 may each be integrated with a different type of firearm 10 and used for synchronized discharge of firearms 10 of different types. As explained further below, device 12 of firearm 10A may be configured to communicate (e.g., wirelessly, as illustrated by arrow W) with device 12 of firearm 10B and/or with other similar device(s) 12 associated with one or more additional firearms 10. While FIG. 1 only shows two firearms 10A, 10B, it is understood that two or more devices 12 may be integrated with two or more respective firearms 10 to permit synchronization of two or more firearms 10. In other words, the synchronized discharge system described herein may include more than two devices 12 associated with respective firearms 10.

The following description refers to firearm 10A for simplicity but it is understood that the same description may also apply to firearm 10B or other firearms 10 to be synchronized together. Like elements are identified using like reference numerals between firearms 10A and 10B in FIG. 1. Firearm 10A may include buttstock 14, scope 16, upper receiver 18, lower receiver 20, hand guard 22, barrel 24, pistol grip 26 and magazine 28. In some embodiments, firearm 10A may have a modular construction where some or all of the above components, and optionally other components, are removably attached together and owners may be able to replace some of the components for customizing firearm 10A according to their personal preferences. For example, buttstock 14 may be removably attached to lower receiver 20. Pistol grip 26 may also be removably attached to lower receiver 20. In various embodiments, pistol grip 26 may be hollow and some or all elements of device 12 may be housed inside of pistol grip 26. In some embodiments, device 12 may include pistol grip 26 as a housing or may include other type of housing. Pistol grip 26 may be a pistol-style grip other than buttstock 14. Pistol grip 26 may be held by a shooter's hand that operates trigger 30, and may orient the hand in a forward, generally vertical orientation, similar to the position that a shooter's hand would take with a conventional pistol.

Trigger 30 may be movable rearwardly from a forward rest position to a firearm-discharge position to actuate the firing sequence of firearm 10A. Trigger 30 may have the form of a pivotable lever that is actuated by an index finger. Trigger 30 may be resiliently biased toward the forward rest position by a spring so that trigger 30 may automatically return to the rest position after discharge of firearm 10A.

Figure 2:
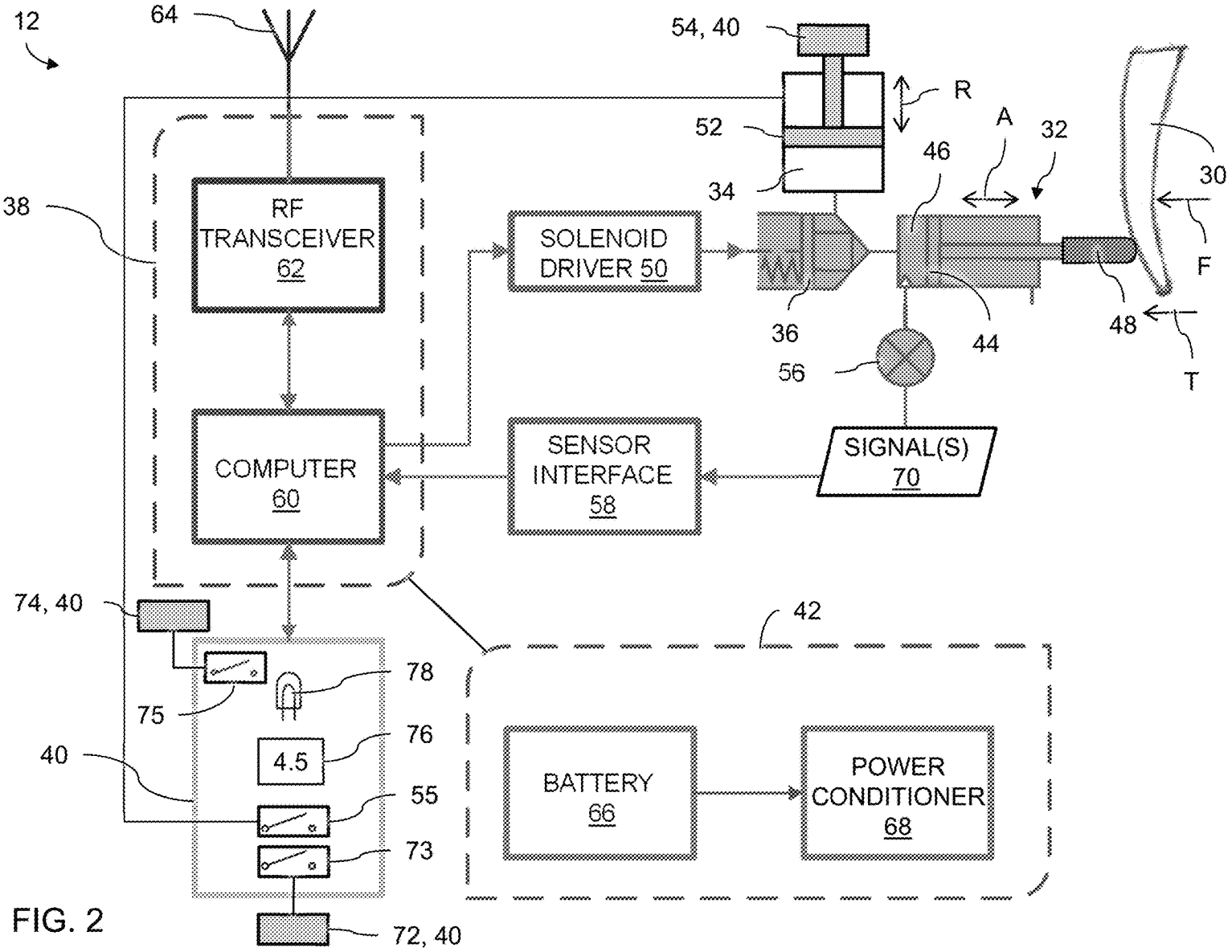
FIG. 2 is a schematic view of an exemplary device for facilitating the synchronized discharge of firearms.

FIG. 2 is a schematic diagram of an exemplary device 12 for facilitating the synchronized discharge of firearms 10. In various embodiments, device 12 may include (e.g., hydraulic) actuator 32 for interfacing with movable trigger 30 of firearm 10, reservoir 34 for receiving hydraulic fluid from actuator 32 or delivering hydraulic fluid to actuator 32, valve 36 operatively disposed between actuator 32 and reservoir 34, controller 38, user interface 40 and power supply 42. In some embodiments, a relatively low-viscosity silicone fluid may be used as hydraulic fluid in device 12. However, other types of substantially non-compressible fluids (e.g., liquids) may also be suitable for use as hydraulic fluid in device 12.

In various embodiments, actuator 32 may be a hydraulic, pneumatic or electric actuator. As shown in FIG. 2, actuator 32 may be a hydraulic cylinder actuatable by a flow of hydraulic fluid to or from actuator 32. Actuator 32 may include actuator piston 44 movable in the directions of arrow A within chamber 46 of actuator 32. Piston 44 may be drivingly coupled to ram 48. Ram 48 may extend toward and engage with a back side of trigger 30. When ram 48 is extended and substantially locked in the extended position, ram 48 may block (e.g., obstruct) the rearward movement of trigger 30 indicated by arrow T and thereby prevent the discharge of firearm 10. When ram 48 is unlocked and permitted to retract, ram 48 may no longer prevent the rearward movement of trigger 30 toward the firearm-discharge position, and consequently, the discharge of firearm 10 by the shooter may be permitted. For example, when ram 48 is unlocked, force F equal to or exceeding a trigger pull weight value (TPWV) of the associated firearm 10 may cause the rearward movement of trigger 30 toward the firearm-discharge position and may urge ram 48 toward its retracted position.

The locked and unlocked configurations of actuator 32 may be achieved by respectively closing and opening valve 36. Closing of valve 36 may prevent the flow of hydraulic fluid into or out of chamber 46 of actuator 32. Opening of valve 36 may permit the flow of hydraulic fluid into or out of chamber 46 of actuator 32. Various known or other types of controllable (e.g., gate, ball, butterfly) valves may be suitable. In some embodiments, valve 36 may be actuated by way of a solenoid. In some embodiments, valve 36 may be normally open (e.g., biased toward the open position), and closed by energizing the solenoid. Accordingly, when device 12 is in the OFF state, no power may be consumed by device 12 to keep valve 36 open. When valve 36 is in the open state, the hydraulic fluid may pass freely from chamber 46 to reservoir 34. Accordingly, ram 48 may be manually retractable and may remain retracted so as not to interfere with the ordinary use of firearm 10.

In some embodiments, valve 36 may be of a type known as a two-way micro solenoid valve. As a non-limiting example, a Series 407M micro solenoid valve sold under the trade name ASCO SCIENTIFIC may be suitable for use as valve 36 in some embodiments. Valve 36 may be operatively coupled to controller 38 via solenoid driver 50 so that the operation of valve 36 may be controlled by controller 38 based on one or more inputs.

When ram 48 is unlocked by the opening of valve 36 and being retracted, the hydraulic fluid being driven out of chamber 46 by actuator piston 44 may flow through open valve 36 and be received in reservoir 34. Reservoir piston 52 may be movably disposed within reservoir 34. Reservoir 34 and reservoir piston 52 may operate as a hydraulic actuator. In reference to FIG. 2, reservoir piston 52 may be movable along the directions of arrow R. For example, reservoir piston 52 may be displaced upwardly to expand reservoir 34 when hydraulic fluid is being received in reservoir 34. On the other hand, downward movement of piston 52 may drive hydraulic fluid out of reservoir 34 and into chamber 38 via open valve 36.

Reservoir piston 52 may be coupled to synchronizing button 54 (referred hereinafter as "sync button 54"), which may be a manual push button and part of user interface 40 of device 12. It is understood that other types of button, switch, knob or other user input device may be suitable. In some embodiments, reservoir piston 52 and sync button 54 may be movable together in unison in the directions of arrow R. Accordingly, sync button 54 may be deployed when hydraulic fluid is received in reservoir 34 and ram 48 is retracted. On the other hand, manually depressing sync button 54 by the shooter may cause hydraulic fluid to be urged out of reservoir 34 and directed to chamber 46 of actuator 32 via open valve 36 in order to cause ram 48 to extend toward the back side of trigger 30. Locking of ram 48 in the extended position may be achieved by closing of valve 36 to substantially prevent hydraulic fluid out of chamber 46.

Sync button 54 may also be operatively coupled to synchronizing switch 55 (referred hereinafter as "sync switch 55") which may be operatively coupled to controller 38. In addition to causing the extension of ram 48, the depression of sync button 54 may also cause the actuation (e.g., closing) of sync switch 55 that, in turn, may cause controller 38 to initiate a synchronization function of device 12. Such synchronization function may include the closing of valve 36 to lock ram 48 in the extended position and also initiate pairing of device 12 with other devices 12 of other firearms 10 within communication range of device 12. Pairing of devices 12 within communication range may allow such devices 12 to communicate together to coordinate and synchronize the unlocking of trigger 30 of respective firearms 10 to facilitate synchronized discharge of those firearms 10.

In some embodiments, the use of a hydraulic actuator instead of a pneumatic actuator may substantially prevent rearward creeping and/or spongy/resilient movement of ram 48 and consequently of trigger 30 when force F is applied to trigger 30. This may be due at least in part to hydraulic fluid (i.e., liquid) being relatively incompressible compared to air (i.e., gas).

It is understood that device 12 may include suitable seals to prevent unwanted leakage of hydraulic fluid at various fluid connections, at actuator 32 and at reservoir 34. For example, such seals may be provided around actuator piston 44 to provide fluid sealing of chamber 46 and around reservoir piston 52 to provide fluid sealing of reservoir 34.

Device 12 may include one or more controllers 38 (referred hereinafter in the singular) operatively coupled to valve 36 via solenoid driver 50, sensor 56 via sensor interface 58 and to user interface 40. Controller 38 may include one or more computers 60 (referred hereinafter in the singular) and one or more radio-frequency (RF) transceivers 62 (referred hereinafter as "transceiver 62") or other suitable wired or wireless communication interface(s). Computer 60 may include one or more data processors and one or more computer-readable memories storing machine-readable instructions executable by the data processor and configured to cause the data processor to generate one or more outputs (e.g., signals) for causing the execution of steps of methods described herein.

Computer 60 may include any suitable device(s) configured to cause a series of steps to be performed by controller 38 so as to implement a computer-implemented process such that the instructions, when executed by computer 60, may cause the functions/acts specified in the methods described herein to be executed. Computer 60 may include, for example, any type of general-purpose microprocessor or microcontroller, a digital signal processing processor, an integrated circuit, a field programmable gate array, a reconfigurable processor, other suitably programmed or programmable logic circuits, or any combination thereof.

The machine-readable memory of computer 60 may include non-transitory computer readable storage medium such as, for example, but not limited to, an electronic, magnetic, optical, electromagnetic, infrared, or semiconductor system, device, or any suitable combination of the foregoing. The memory may include a suitable combination of any type of computer memory that is located either internally or externally to computer 60. The memory may include any storage means (e.g. devices) suitable for retrievably storing machine-readable instructions executable by computer 60.

Various aspects of the present disclosure may be embodied as systems, devices, methods and/or computer program products. Accordingly, aspects of the present disclosure may take the form of an entirely hardware embodiment, an entirely software embodiment or an embodiment combining software and hardware aspects. Furthermore, aspects of the present disclosure may take the form of a computer program product embodied in one or more non-transitory computer readable medium(ia) having computer readable program code embodied thereon. Computer program code for carrying out operations for aspects of the present disclosure may be written in any combination of one or more programming languages. Such program code may be executed entirely or in part by computer 60 or other data processing device(s). It is understood that, based on the present disclosure, one skilled in the relevant arts could readily write computer program code for implementing the methods disclosed herein.

In some embodiments, controller 38 may be a microcontroller or may include a microcontroller. Controller 38 may include one or more processor cores along with memory and programmable input/output peripherals. As a non-limiting example, controller 38 may, in some embodiments, be an ultra-low-power, dual-band wireless microcontroller such as model CC1350 SimpleLink™ sold under the trade name TEXAS INSTRUMENTS.

Transceiver 62 may be operatively connected to computer 60 and to one or more antennae 64. Transceiver 62 may include both a transmitter and a receiver to permit both wireless data transmission and data reception. Transceiver 62 may permit data communication such as pairing with one or more controllers 38 of other devices 12 within communication range, and exchange of parameters/states with one or more of such other controllers 38. Transceiver 62 may permit data communication using Bluetooth, Wi-Fi, radio signals, or the like to communicate between different paired devices 12 associated with different firearms 10A, 10B. Controller 38 may, instead or in addition, be paired with one or more mobile phones or other portable electronic device(s) to enable the devices 12 to communicate over greater distances via such portable electronic device(s) able to communicate over a cellular telecommunication network for example. Settings or other user input(s) may be communicated to controller 38 via an application (app) loaded on another (e.g., portable/mobile) electronic device that is in communication with controller 38 for example. In some embodiments, transceiver 62 may be configured for wireless data communication at one or more frequencies (e.g., 915 MHZ and/or at 2.4 GHz).

Power supply 42 may include battery 66 and optional power conditioner 68. In some embodiments, battery 66 may be rechargeable. Power conditioner 68 may be configured to perform conditioning of power delivered from battery 66 to controller 38 or to one or more other components of device 12. In some embodiments, power conditioner 68 may be a direct current (DC) to DC converter to step up a voltage from battery 66 according to the requirements of one or more powered components of device 12. In some embodiments, power conditioner 68 may be a step-up switching voltage regulator. In some embodiments, power conditioner 68 may be a pulse width modulated (PWM) DC to DC converter. As a non-limiting example, a voltage regulator such as model number MAX751 sold under the trade name MAXIM INTEGRATED may be suitable for use as power conditioner 68 in some embodiments.

Device 12 may also include sensor 56 configured to generate one or more signals 70 indicative of a force F applied to trigger 30. Sensor 56 may be operatively coupled to controller 38 via sensor interface 58. In some embodiments, sensor 56 may be a force sensor (e.g., strain gage, load cell) installed to generate signal 70 indicative of force F applied to trigger 30. In some embodiments, sensor 56 may be disposed on a front side of trigger 30 to generate signal 70 indicative of force F applied to trigger 30. In some embodiments, sensor 56 may indirectly measure force F by way of measuring the pressure of the hydraulic fluid in chamber 46. Various types of pressure sensors may be suitable. Sensor interface 58 may be include signal conditioning circuitry (e.g., analog to digital conversion) that receives signal(s) 70 and provides controller 38 with suitable signal(s) representative of signal(s) 70. Machine readable instructions executed by controller 38 may utilize the pressure value(s) directly in computations or may correlate the pressure value(s) to equivalent force(s) F applied to trigger 30.

Device 12 may also include power button 72, which may be part of user interface 40. Power button 72 may be a push button operatively coupled to power switch 73. Power button 72 may be used to activate (e.g., power on) device 12 and optionally also shut off device 12. It is understood that other types of button, switch, knob or other user input device may be suitable.

Device 12 may also include optional message button 74, which may be part of user interface 40. Message button 74 may be a push button operatively coupled to message switch 75 operatively coupled to controller 38. It is understood that other types of button, switch, knob or other user input device may be suitable. Message button 74 may be used by one shooter to send a message to one or more other shooters of other firearm(s) 10 that have respective devices 12 within communication range of the present device 12. Message button 74 may provide a means of communication between shooters. The meaning of the message may be previously agreed upon by the applicable shooters and may include "commence firing procedure", "cease firing procedure" or "wait" for example.

The actuation of message switch 75 may cause controller 38 of the messaging shooter to communicate a signal to other devices 12 within communication range. Upon receipt of such signal, the other devices 12 may cause their respective indicators 78 to provide a visual indication indicative of the signal received. Such visual indication may be the emission of (e.g., white) light or other color (e.g., by a LED) that is not associated with another state of the respective device 12. The signal may be communicated by controller 38 of the messaging shooter to other devices 12 that are paired with device 12 of the messaging shooter. Alternatively, controller 38 may broadcast the signal so that other devices 12 within communication range (paired or not paired with the present device 12) and powered ON may all receive the signal and cause the applicable visual indication to be provided to their respective shooters via their respective indicators 78. In some embodiments, the receipt of the signal may cause the receiving controller(s) 38 to cause whatever indication currently provided by the applicable indicator 78 to be overridden by the new visual indication indicative of the message.

In some embodiments, message button 74 may be resiliently biased (e.g., via a spring) toward the undepressed position. In some embodiments, releasing message button 74 may cause the associate visual indication provided to the other shooters by the other devices 12 to be terminated. In some embodiments, controller 38 may be configured so that the termination of the messaging visual indication is followed by resuming the previous visual indication that was provided by indicator(s) 78 immediately before the signal was received. In some embodiments, depressing message button 74 may also cause the present indicator 78 of the messaging shooter to provide the messaging visual indication as a confirmation to the messaging shooter that the message has been sent to the other shooters.

User interface 40 may also optionally include analog or digital readout 76 (e.g., display, dial) that may indicate a prescribed pull weight value (PPVW) that is equal to or higher than the TPVW of the applicable firearm 10. The TPVW may be measured in pounds (lbs) applied to trigger 30 to make it break or trip, transition to the firearm-discharge position and hence cause the discharge of firearm 10. The TPVW can vary greatly on handheld firearms based on a shooter's preference. For example, typical TPVW may vary from 1 lb (4.45 N) to 12 lbs (53.4 N). An AR style rifle may have a TPVW within the range of 3 lbs (13.3 N) to 9 lbs (40 N) for example. Even firearms 10 of the exact same make and model may have different TPVW because the TPVW on some triggers may be adjustable and/or stock triggers may be replaced with higher performance custom triggers of lower TPVW.

The PPVW may be used by controller 38 to determine when valve 36 should be opened to enable synchronized discharge. For example, one criterion used by controller 38 may be that the force F is equal to or exceeds the PPVW (i.e., F PPVW). Force F applied to trigger 30 may be monitored via sensor 56 and controller 38 may continuously or intermittently monitor the force F applied to trigger 30 against the PPVW. The force F reaching or exceeding the PPVW may be indicative of the shooter of the applicable firearm 10 being ready to discharge firearm 10. Accordingly, the PPVW of device 12 may be higher than the TPVW of the applicable firearm 10 so that the threshold force F meeting the criterion is sufficiently high to cause trigger 30 to transition to the firearm-discharge position with little to no delay upon opening of valve 36.

In some embodiments, controller 38 may be provided with a fixed/standard PPVW that is higher than an expected TPVW of firearm 10. The fixed PPVW may be about 10 lbs (44.5 N) for example. Alternatively, controller 38 may be provided with a variable PPVW that may be adjusted by the shooter to accommodate the shooter's preference of TPWVs. In some embodiments, readout 76 that may indicate the PPVW to be used by controller 38 during the synchronized firearm discharge. In some embodiments, the PPVW may be varied by increments of 0.5 lbs (2.2 N) for example by repeatedly pressing power button 72 or another user input device, and may cycle from a minimum value to a maximum value by repeatedly pressing power button 72 for example. The shooter may accordingly set the PPVW to be 0.5 lb (2.2 N), 1 lb (4.4 N) or more higher than the TPVW of the applicable firearm 10. In some embodiments, the PPVW may be communicated to controller 38 via an application (app) loaded on another (e.g., portable/mobile) electronic device that is in communication with controller 38.

In some embodiments, user interface 40 may also include indicator 78 providing a visual indication of the state of device 12 to the applicable shooter substantially in real time. In some embodiments, indicator 78 may be a display screen or readout providing a textual or graphic indication. In some embodiments, indicator 78 may include a signal light. In some embodiments, indicator 78 may include a variable color light-emitting diode (LED) that may provide an indication of the state of device 12 by way of a color of the light emitted and/or whether the LED is flashing/blinking for example.

Figure 3:
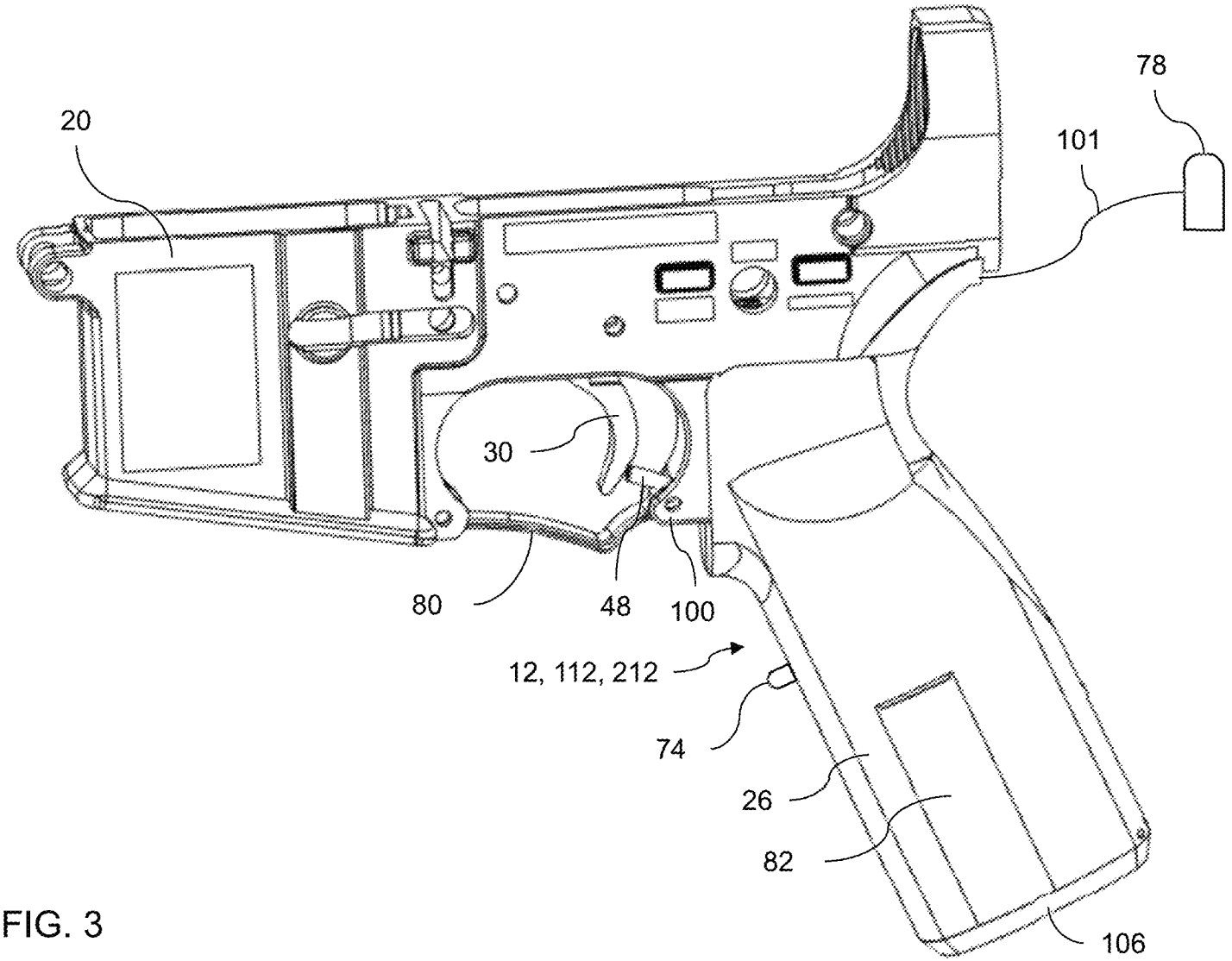
FIG. 3 is a tridimensional view of an exemplary assembly including a lower receiver of a firearm and the device of FIG. 2 integrated with a pistol grip of the firearm.

FIG. 3 is a tridimensional view of an exemplary assembly including lower receiver 20 of firearm 10 and device 12 integrated with pistol grip 26 of firearm 10. In some embodiments, some or all of the components of device 12 may be housed within the confines of pistol grip 26. Alternatively, some of the components of device 12 may be housed in some other housing separate from pistol grip 26.

In some embodiments, device 12 may be installed (e.g. retrofitted) on firearm 10 relatively easily by replacing an existing pistol grip of firearm 10 with pistol grip 26 that houses device 12. Pistol grip 26 may be made to easily attach to lower receiver 20 to facilitate installation without extensive modifications or gunsmithing of firearm 10 being required. In some embodiments, a modified trigger guard 80 allowing the passage of ram 48 may be supplied with device 12 to replace an existing trigger guard of firearm 10.

In some embodiments, pistol grip 26 may include door 82 for accessing the interior of pistol grip 26. Door 82 may be sized to permit replacement or recharging battery 66. Door 82 may be a slidable panel or may be a hinged panel that is movably attached to pistol grip 26.

Message button 74 may be disposed at any location that is convenient and readily accessible by the shooter during a shooting procedure. In various embodiments, message button 74 may be disposed on pistol grip 26. For example, message button 74 may be disposed on a front side of pistol grip 26 at a location between a middle finger and a ring finger of the shooter.

Figure 4:
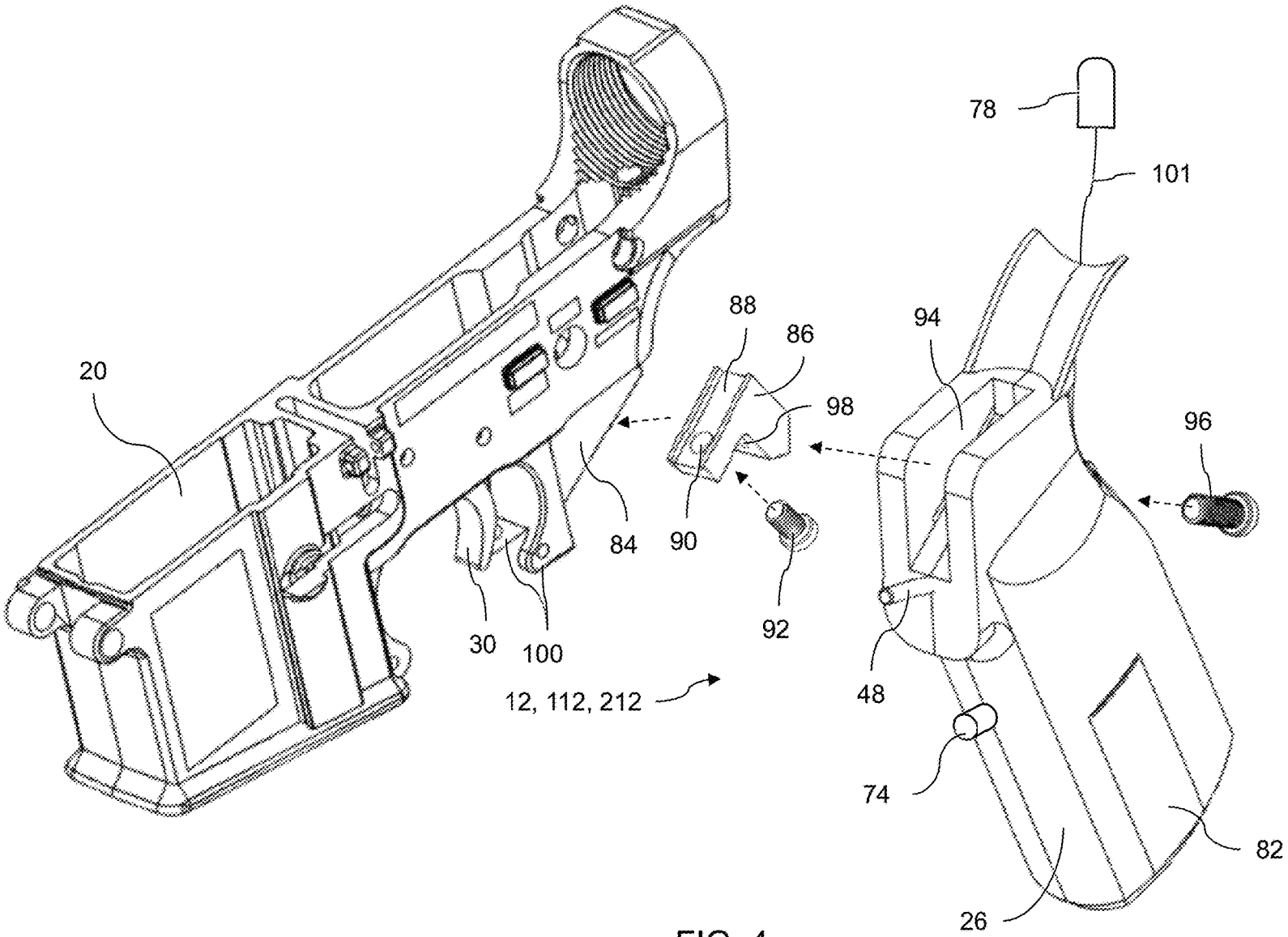
FIG. 4 is a tridimensional view illustrating an exemplary method of assembling the pistol grip of FIG. 3 to the lower receiver.

FIG. 4 is a tridimensional view illustrating an exemplary method of assembling pistol grip 26 (including device 12) to lower receiver 20. In some embodiments, pistol grip 26 may be attachable to pistol grip interface 84 of lower receiver 20. Pistol grip interface 84 may include one or more surfaces with which a conventional pistol grip of firearm 10 may be engaged and one or more threaded holes normally used for securing the conventional pistol grip to lower receiver 20 via one or more bolts. With respect to pistol grip 26, adaptor block 86 may be provided with device 12 to facilitate attachment of pistol grip 26 to pistol grip interface 84. Adaptor block 86 may include channel 88 for engagement with pistol grip interface 84. Adaptor block 86 may also include through hole 90 allowing adaptor block 86 to be releasably secured to pistol grip interface 84 using bolt 92.

Once adaptor block 86 is secured to pistol grip interface 84, pistol grip 26 may be positioned so that part of adaptor block 86 and pistol grip interface 84 are received into and engaged with receptacle 94 defined in an upper portion of pistol grip 26. Then, pistol grip 26 may be releasably secured to adaptor block 86 by threading bolt 96 into threaded hole 98 of adaptor block 86. Bolt 96 may be accessible from a rear exterior side of pistol grip 26 via a hole formed in pistol grip 26 to permit tightening and loosening of bolt 96 from the exterior of pistol grip 26. Once pistol grip 26 is installed on lower receiver 20, ram 48 may be disposed between ears 100 of lower receiver 20 and extendable to the back side of trigger 30. Accordingly, the installation of handgrip 26 and hence device 12 on firearm 10 may be relatively easy and may not interfere with the original design or internal components of firearm 10.

Figure 5:
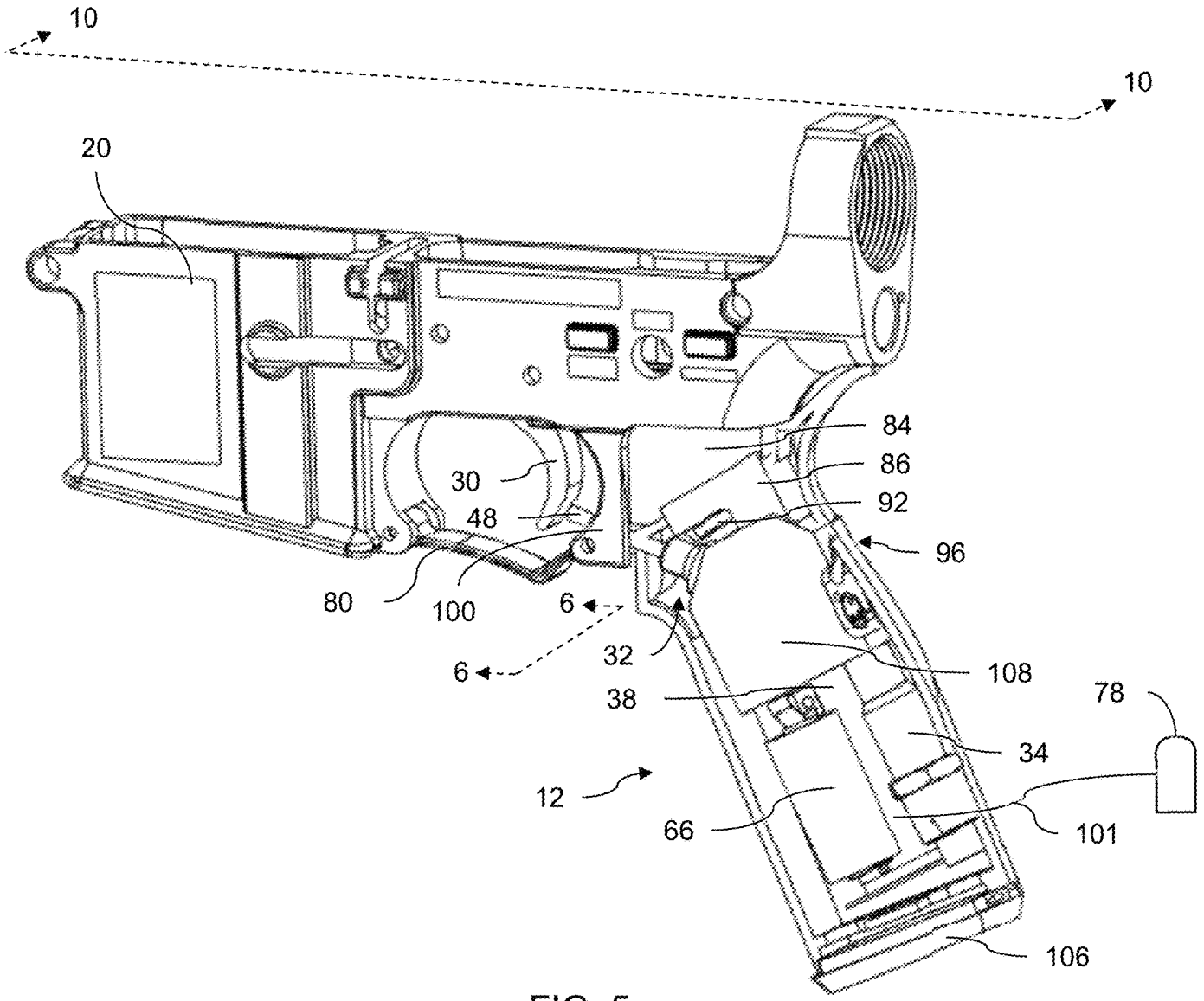
FIG. 5 is a tridimensional view illustrating the pistol grip and lower receiver of FIG. 3 with part of the pistol grip removed to show an interior of the pistol grip.

FIG. 5 is a tridimensional view illustrating pistol grip 26 and lower receiver 20 with part of pistol grip 26 removed to show components of device 12 housed in an interior of pistol grip 26. Pistol grip 26 may have an other shell for interfacing with a hand of the shooter. In some embodiments, pistol grip 26 may be made from a polymeric (e.g., plastic) material. For example, pistol grip 26 may be made by overmolding a polymeric material over components of device 12 by injection molding. In some embodiments, pistol grip 26 may have a clamshell construction where two lateral halves of pistol grip 26 may be formed by injection molding and assembled (e.g., bonded, glued, fastened) together to define a housing for components of device 12. Components of device 12 such as actuator 32, controller 38, valve 36, reservoir 34, power supply 42 and body 108 may be disposed inside of pistol grip 26. In various embodiments, components of device 12 disposed inside of handgrip 26 may have metallic (e.g., aluminum alloy, steel) or polymeric respective housings. Adaptor block 86 and body 108 may be made of metallic (e.g., aluminum alloy, steel) or polymeric materials. Indicator 78 may be operatively coupled to controller 38 via lead 101 providing a wired connection therebetween.

Device 12 may also include bottom cover 106 that may be removably or hingedly attached to pistol grip 26. Cover 106 may provide access to components that are disposed inside of pistol grip 26. In some configurations of device 12, cover 106 may provide access to replace battery 66 and door 82 (shown in FIG. 4) may not be required.

Replacement trigger guard 80 may be integrally formed with pistol grip 26 or may be provided as a separate component from pistol grip 26. A front end of trigger guard 80 may be attached to lower receiver 20 using a roll pin. A kit including device 12 may include pistol grip 26 housing components of device 12, and trigger guard 80. Such kit may also include adaptor block 86.

Figure 6:
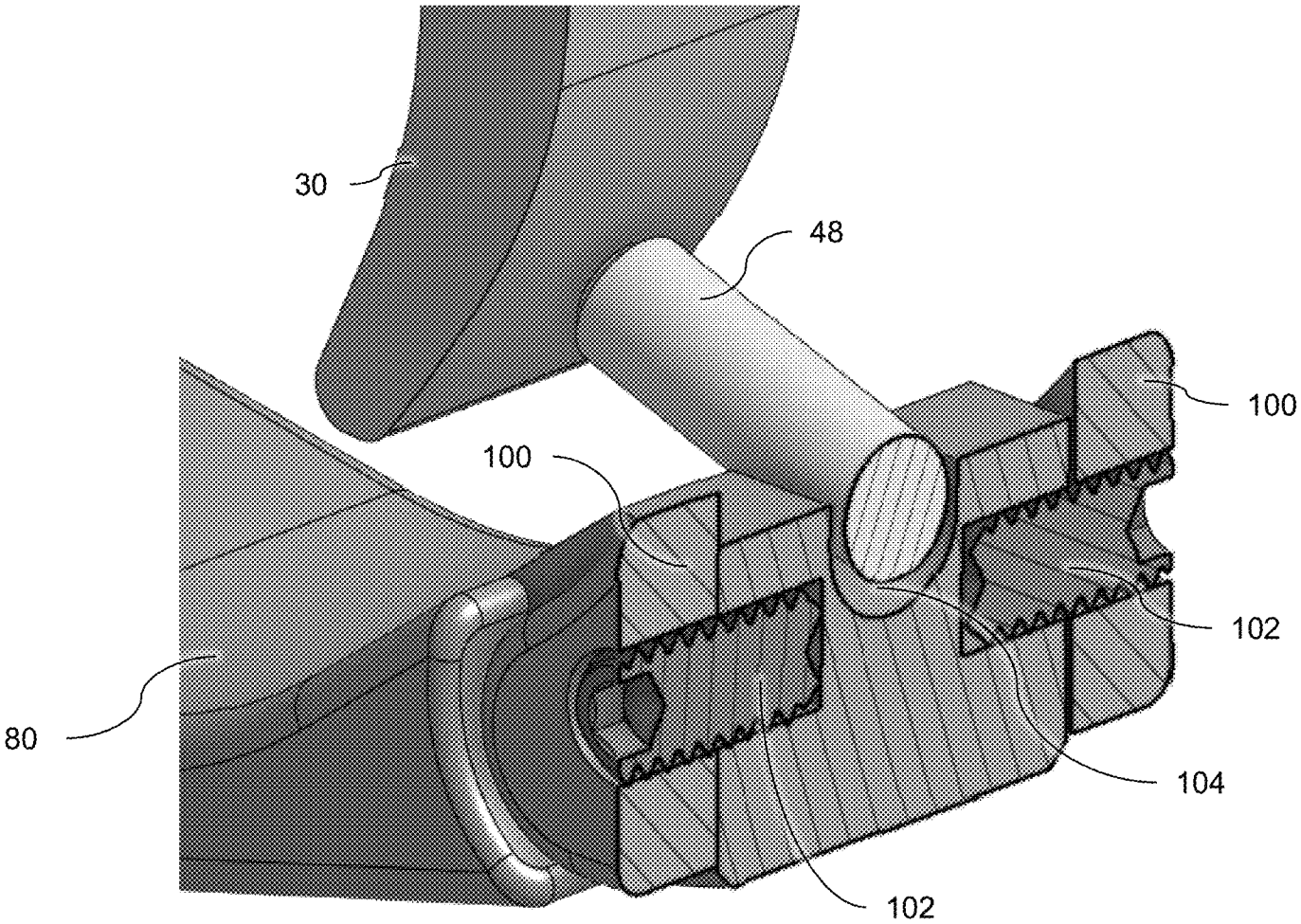
FIG. 6 is a tridimensional cross-sectional view of a rear end of an exemplary trigger guard taken along line 6-6 in FIG. 5.

FIG. 6 is a tridimensional cross-sectional view of a rear end of trigger guard 80 taken along line 6-6 in FIG. 5. The rear end of trigger guard 80 may be attached to lower ears 100 of lower receiver 20 using one or more roll pins or set screws 102. In some embodiments, the rear end of trigger guard 80 may be slotted to provide passage 104 through which ram 48 may extend toward the back side of trigger 30. In such embodiments, the rear end of trigger guard 80 may be attached to ears 100 using respective set screws 102 that are threaded into trigger guard 80 and engaged with respective ears 100. For example, set screws 102 may be threaded into (e.g., blind) threaded holes formed in trigger guard 80. The length of set screws 102 may be selected to extend to the bottom of the respective blind holes formed in trigger guard 80 and also be substantially flush with or recessed within laterally outer sides of ears 100.

Figure 7B:
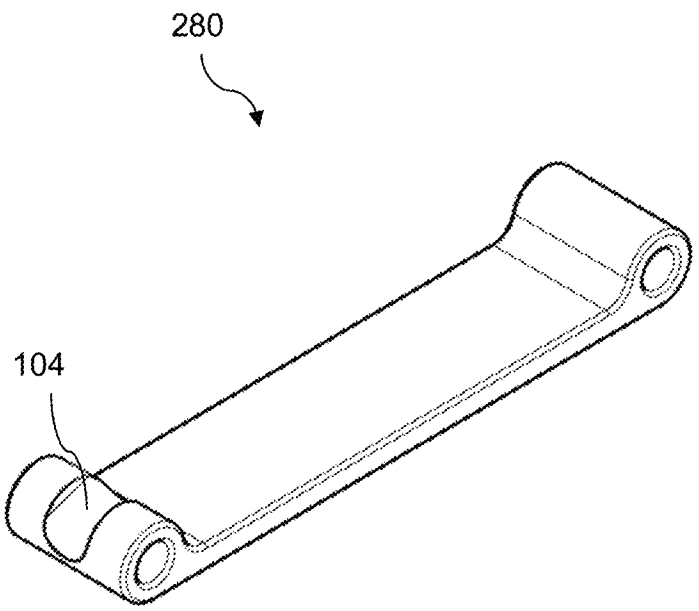
FIG. 7B is a tridimensional view of another exemplary trigger guard.
Figure 7A:
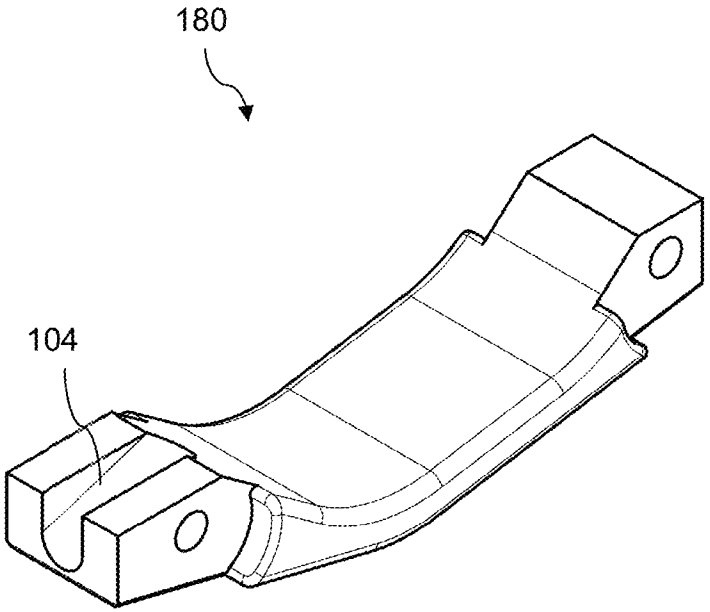
FIG. 7A is a tridimensional view of another exemplary trigger guard.

FIG. 7A is a tridimensional view of another exemplary trigger guard 180 that may be suitable for use with device 12. Trigger guard 180 may also have a slotted rear end to define passage 104 for ram 48.

FIG. 7B is a tridimensional view of another exemplary trigger guard 280 that may be suitable for use with device 12. Trigger guard 280 may also have a slotted rear end to define passage 104 for ram 48.

Figure 8:
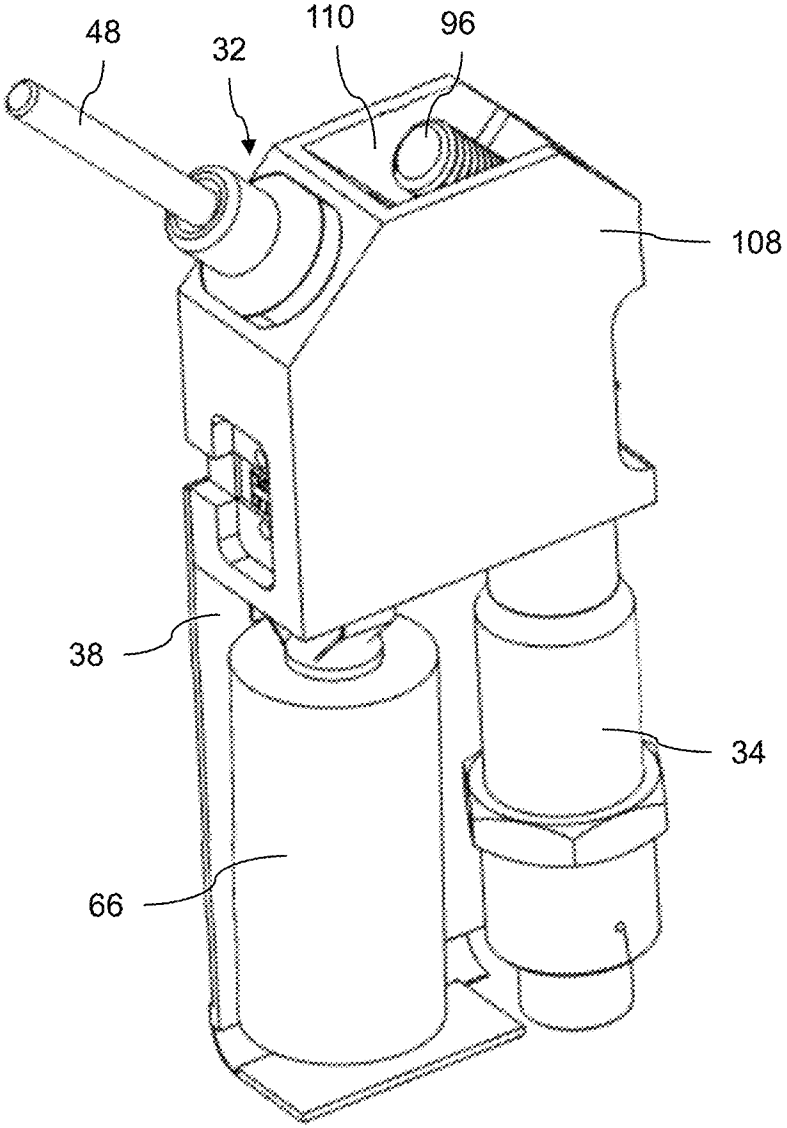
FIG. 8 is a tridimensional view of exemplary components of the device of FIG. 2 housed in the pistol grip of FIG. 5, shown in isolation.

FIG. 8 is a tridimensional view of an exemplary assembly of components of device 12 that may be housed in pistol grip 26. Body 108 may serve as a base structure of device 12 to which various components of device 12 may be attached or in which components may be housed. Some components of device 12 such as actuator 32 and sensor 56 may be housed in body 108. Body 108 may have receptacle 110 for receiving and engaging with part of adaptor block 86 (shown in FIG. 4) when pistol grip 26 is attached to lower receiver 20.

Figure 9:
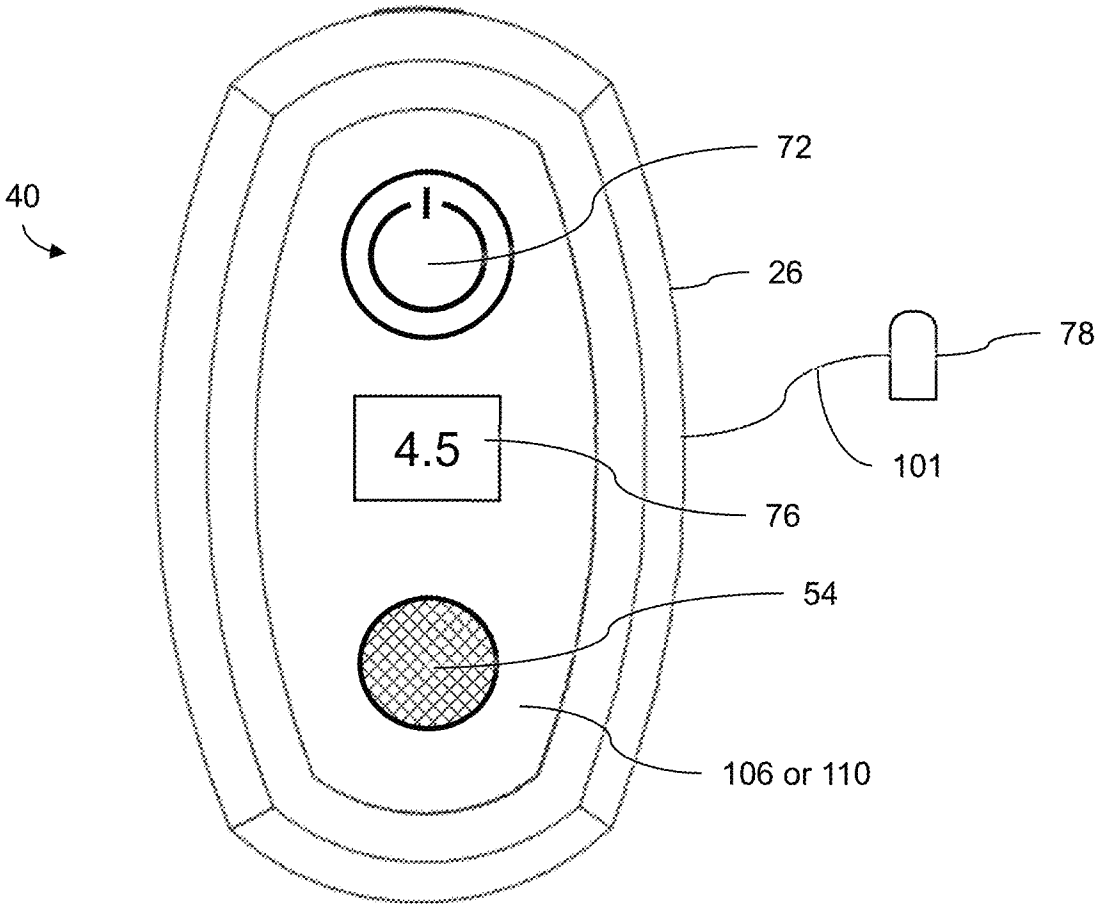
FIG. 9 shows an exemplary user interface of the device of FIG. 2.

FIG. 9 shows an exemplary user interface 40 of device 12. Part(s) of user interface 40 may be disposed on pistol grip 26. For example, part(s) user interface 40 may be disposed in a lower end region (e.g., a bottom side) of pistol grip 26. Component(s) of user interface 40 may be disposed on cover 106 or may be disposed on panel 110 that may be disposed under cover 106 and concealed by cover 106 when desired. For example, user interface 40 may be made accessible to the shooter when cover 106 is opened or removed from pistol grip 106.

Figure 10:
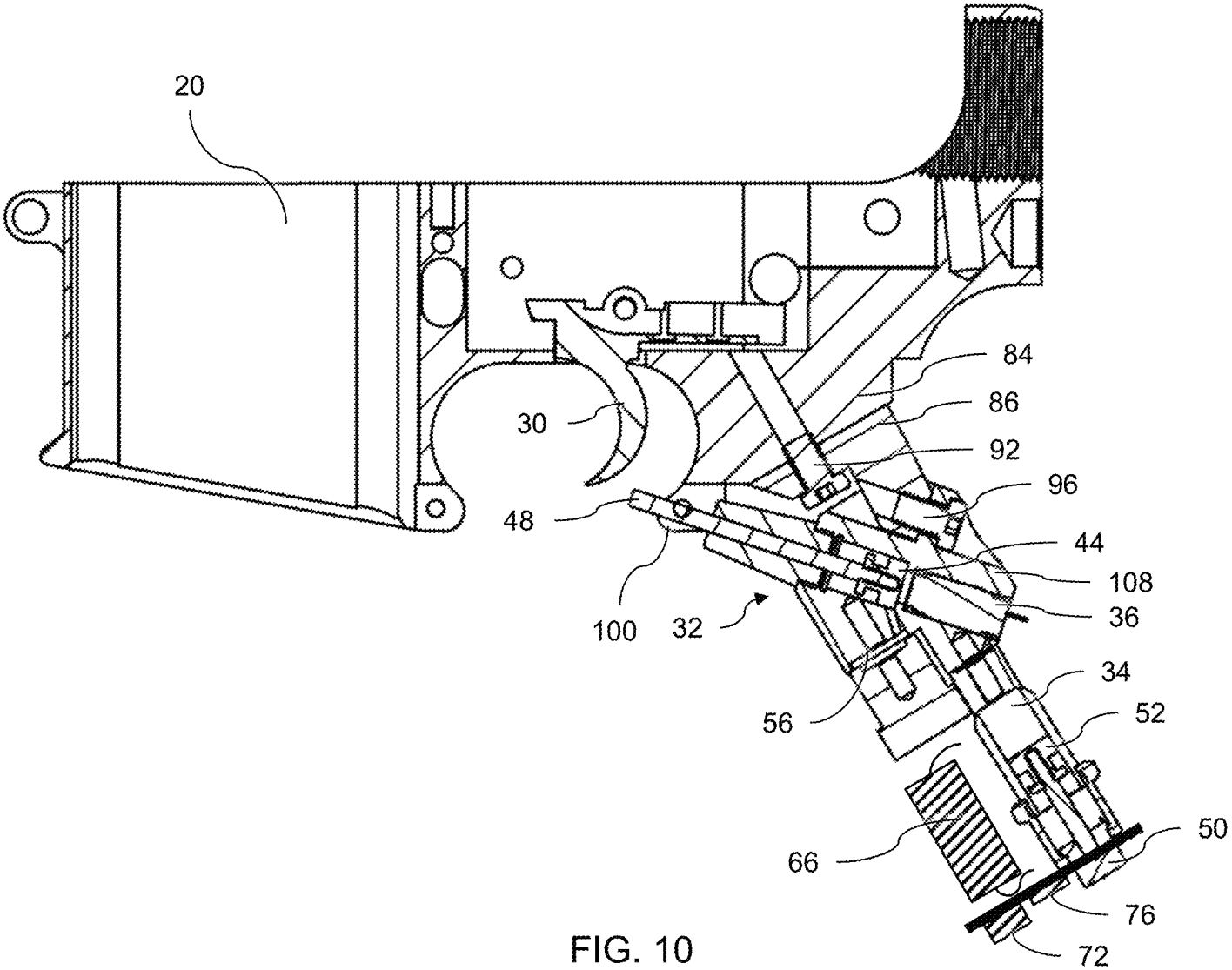
FIG. 10 is a partial cross-sectional view of the assembly of FIG. 5 taken along line 10-10 in FIG. 5.

FIG. 10 is a partial cross-sectional view of the assembly of FIG. 5 taken along line 10-10 in FIG. 5. FIG. 10 shows an exemplary internal configuration of various components of device 12. Trigger guard 80, controller 38 and indicator 78 are not shown in FIG. 10. Actuator 32 is shown in a state where ram 48 is retracted and piston 44 is also shown in a retracted position where the volume of chamber 46 (shown in FIG. 2) has been reduced so that part of the hydraulic fluid has been transferred to reservoir 34. In the position of ram 48 shown in FIG. 10, trigger 30 may be freely moved to the firearm-discharge position to permit the ordinary utilization of firearm 10. In the embodiment of actuator 32 shown in FIG. 10, a side of piston 44 opposite of chamber 46 may be vented to the atmosphere.

In an alternate configuration of device 12, actuator 32 could instead be a double acting hydraulic cylinder that would not require reservoir 34. This would be a closed hydraulic system with a hydraulic fluid line going from a first port on one side of the piston to a second port on the opposite side of the piston. In this way, movement of the piston would cause the hydraulic fluid to flow from one side of the piston to the other. Valve 36 may be operatively disposed along this hydraulic fluid line to permit the selective locking of the actuator in a position where ram 48 is extending to the back side of trigger 30. In such embodiment, a relatively light spring may be disposed inside of the actuator and urge the piston toward the position where ram 48 is extending to the back side of trigger 30 to cause the actuator to automatically return to this position when valve 36 is open and the force F (shown in FIG. 2) is removed from trigger 30.

Figure 11:
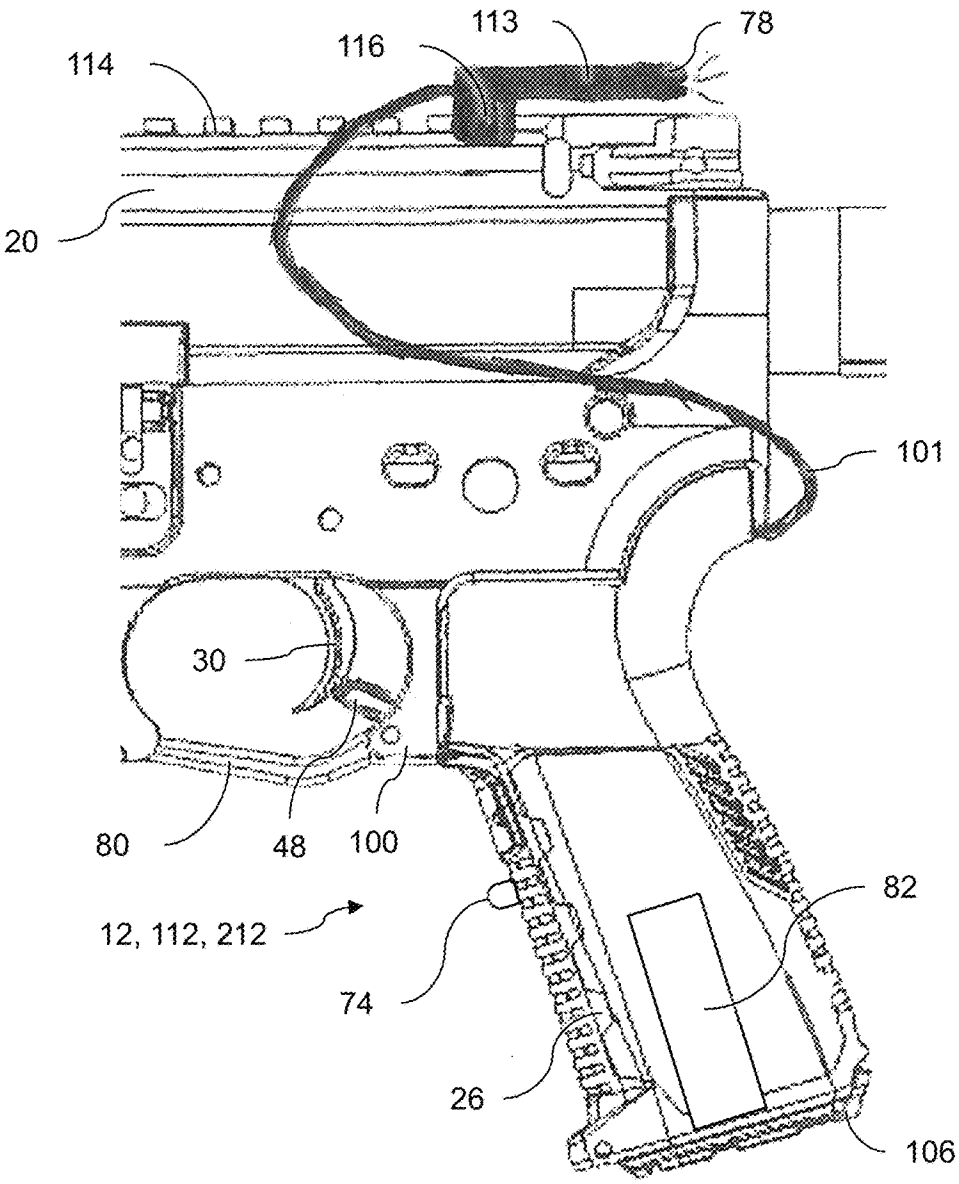
FIG. 11 is a partial side elevation view of an exemplary firearm including the device of FIG. 2 showing an exemplary location of a visual indicator.

FIG. 11 is a partial side elevation view of an exemplary firearm 10 including device 12 of FIG. 2 showing an exemplary location of visual indicator 78. Indicator 78 may be connected to controller 38 via lead 101 which may, for example, be 2 inches (5 cm) to 12 inches (30 cm) long to permit the placement of indicator 78 at a suitable location on firearm 10 where the shooter may see and recognize the colour indicated by indicator 78 without having to look directly at indicator 78 (e.g., using peripheral vision) and being overly distracted. Accordingly, the shooter may stay focused on the target by aiming using a scope or iron sights of firearm 10. Indicator 78 may also be positioned in such a way that only the shooter may see it and/or not give off significant ambient light that may be distracting to others. This may be done by putting optional tube 113 around indicator 78 and being open toward the shooter to restrict the line of sight to indicator 78 to only the shooter and eliminating any ambient/extra light reflecting off other surfaces. In other words, indicator 78 may be disposed inside of tube 113 which may be open toward the shooter's eye. In some embodiments, indicator 78 may be movably attachable to Picatinny rail 114 via bracket 116 attached to tube 113 and/or indicator 78. Bracket 116 may be slideable along Picatinny rail 114 to permit positional adjustment of indicator 78.

Figure 12:
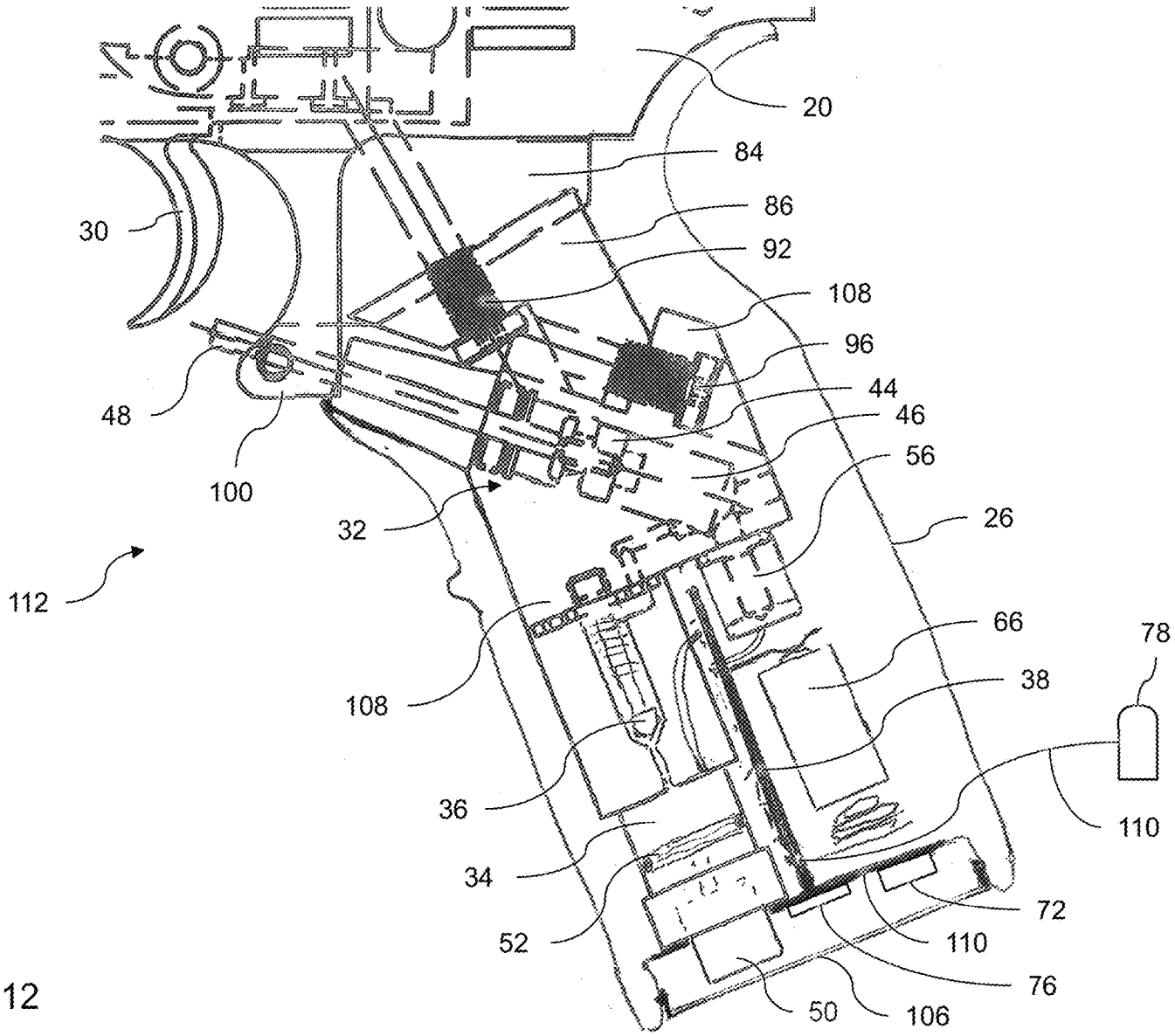
FIG. 12 is a schematic side elevation view of another exemplary device for facilitating the synchronized discharge of firearms.

FIG. 12 is a schematic side elevation view of another exemplary device 112 for facilitating the synchronized discharge of firearms 10. Device 112 may include some or all of the components of device 12 described above. Like elements are identified using like reference numerals. In contrast with device 12, device 112 shows an alternate placement of some components within pistol grip 26. For example, the respective positions of battery 66 and reservoir 34 may be switched. Controller 38 may also be disposed between reservoir and battery 66 as shown in an edgewise orientation in FIG. 12. Components of user interface 40 may also be disposed on panel 110 that may be protected and concealed by cover 106.

Figure 13:
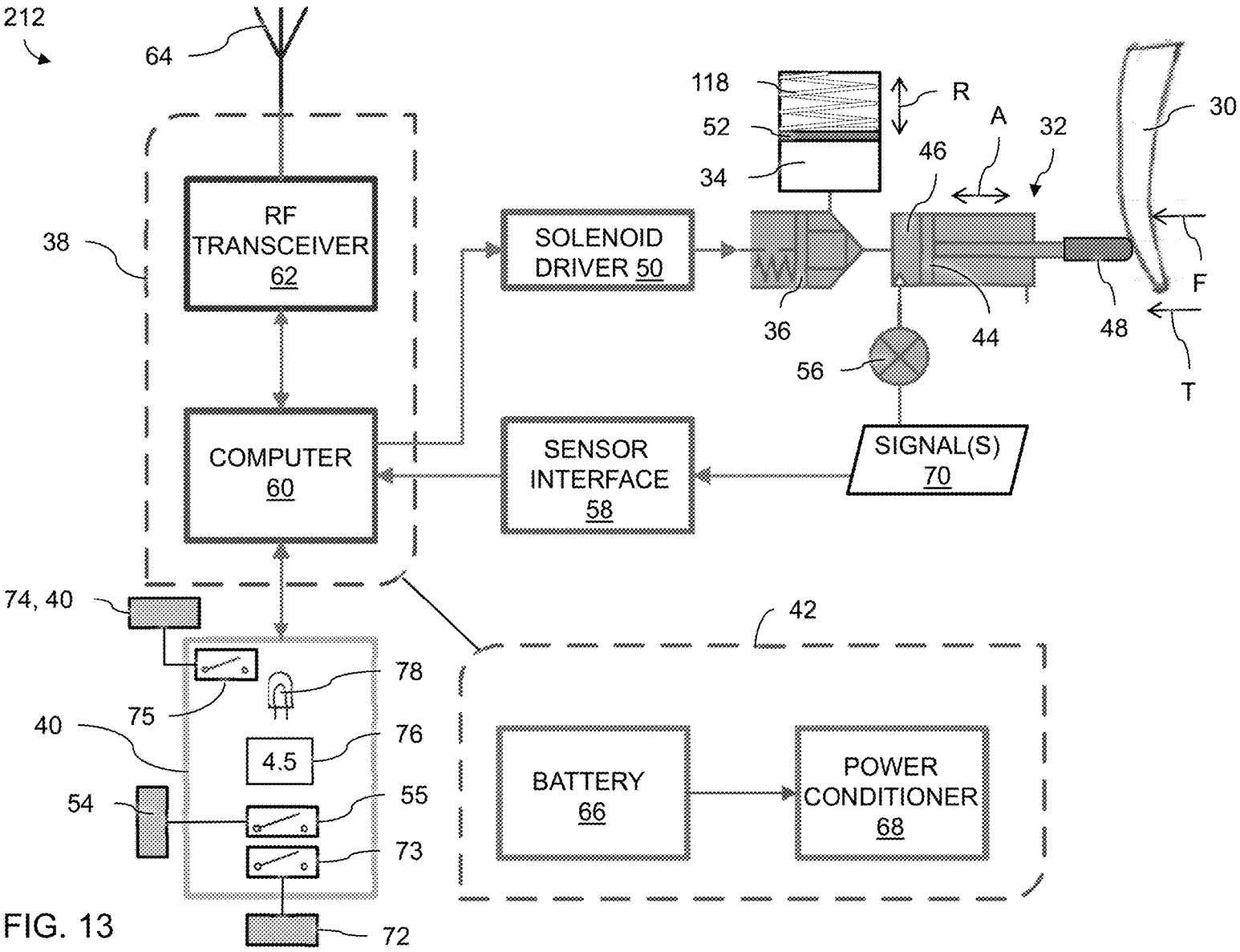
FIG. 13 is a schematic view of another exemplary device for facilitating the synchronized discharge of firearms.

FIG. 13 is a schematic view of another exemplary device 212 for facilitating the synchronized discharge of firearms 10. Device 212 may include some of the components of device 12 described above. Like elements are identified using like reference numerals. In contrast with device 12, device 212 shows sync button 54 being disconnected from reservoir piston 52. Instead of being movable by the actuation of sync button 54, reservoir piston 52 may be urged downwardly by spring 118 in reference to FIG. 13. Accordingly, ram 48 may be returned to the back side of trigger 30 by opening valve 36 and letting spring 118 act on reservoir piston 52 to drive the hydraulic fluid out of reservoir 34 and into chamber 46. In this embodiment, valve 36 may be in a normally-closed position when device 12 is in the OFF state so that ram 48 may be kept in the retracted position when device 12 is OFF to permit ordinary (i.e., unsynchronized) use of firearm 10.

When ram 48 is extended to the back side of trigger 30 and ram 48 is unlocked by the opening of valve 36 when force F equals to or exceeds the PPWV, the rearward movement of trigger 30 toward its firearm-discharge position may urge ram 48 to retract. The movement of actuator piston 44 by the retraction of ram 48 may cause the hydraulic fluid to flow out of chamber 46 and into reservoir 34 via open valve 36. Such flow of hydraulic fluid may cause the compression of spring 118 and the expansion of reservoir 34 to receive the hydraulic fluid therein.

Figure 14:
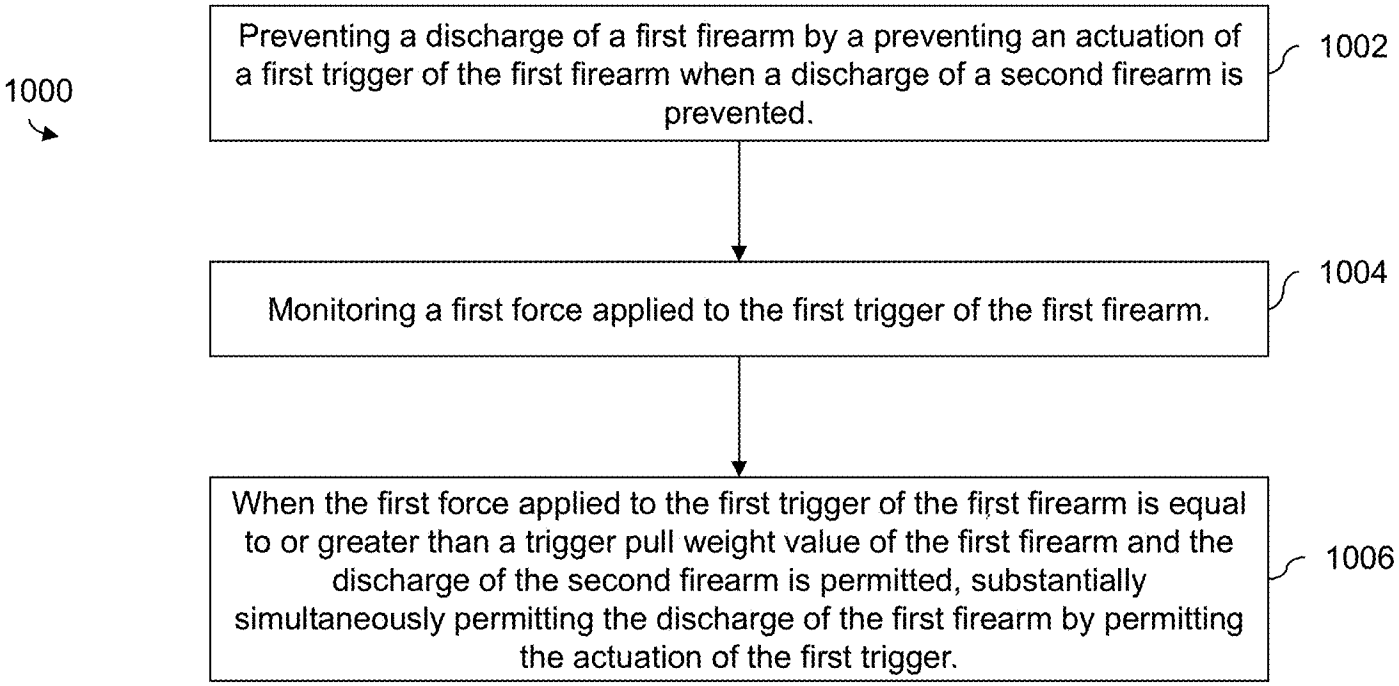
FIG. 14 is a flowchart of an exemplary method for facilitating a synchronized discharge of firearms.

FIG. 14 is a flowchart of an exemplary method 1000 for facilitating a synchronized discharge of two or more firearms 10. Method 1000 may be performed using devices 12, 112 and 212 described herein or using other devices. It is understood that aspects of method 1000 may be combined with aspects of other methods described herein. In various embodiments, method 1000 may include:

- preventing a discharge of first firearm 10A by a preventing an actuation of trigger 30 of first firearm 10A to a first firearm-discharge position when a discharge of second firearm 10B is prevented (see block 1002);
- monitoring force F applied to trigger 30 of first firearm 10A (see block 1004); and
- when force F applied to trigger 30 of first firearm 10A is equal to or greater than the TPWV value of first firearm 10A and the discharge of second firearm 10B is permitted, permitting the discharge of first firearm 10A by permitting the actuation of trigger 30 of first firearm 10A.

Figure 15:
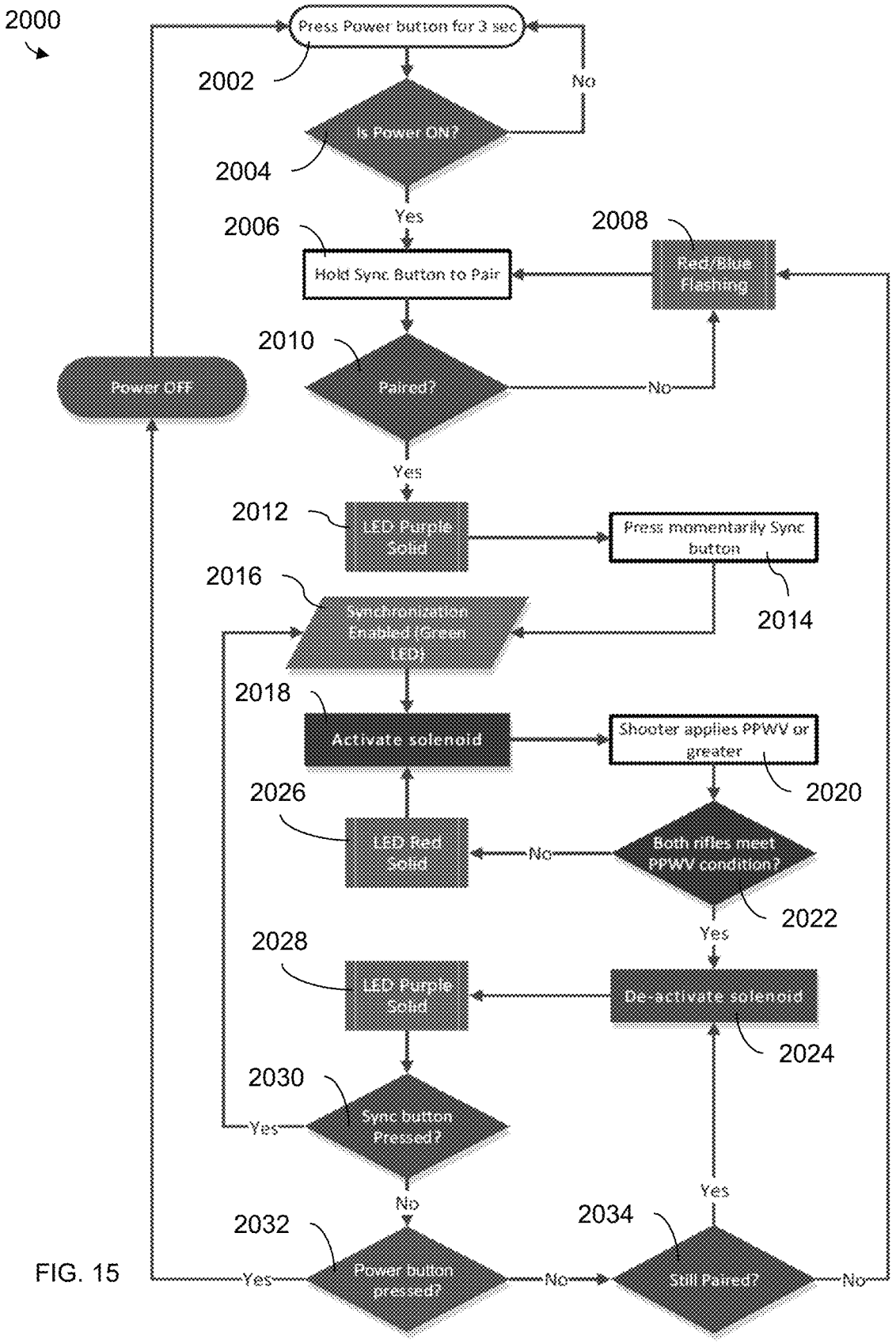
FIG. 15 is a flowchart of another exemplary method for facilitating the synchronized discharge of firearms.

FIG. 15 is a flowchart of another exemplary method 2000 for facilitating a synchronized discharge of two or more firearms 10. Method 2000 may be performed using devices 12, 112 and 212 described herein or using other devices. Aspects of method 2000 may be combined with aspects of method 1000 or other methods described herein.

Aspects of method 2000 are described in relation to components of device 12. At block 2002, power button 72 may be pressed (e.g., for 3 seconds) to power on device 12 as shown in decision block 2004. At block 2006, sync button 54 may be pressed and held to cause ram 48 to extend to the back side of trigger 30 and also to cause device 12 to be paired with one or more other devices 12 that are within communication range. The pairing status of device 12 may be indicated by indicator 78 (e.g., LED). For example, an unpaired status may be indicated by causing indicator 78 to emit alternating flashes of red and blue light as shown at block 2008. If, at decision block 2010, device 12 is determined to be successfully paired with one or more other devices 12, the successful pairing of device 12 may be indicated by indicator 78 providing a solid (i.e., non flashing) purple indication as shown at block 2012.

Once device 12 is successfully paired with one or more other devices 12, sync button 54 may be pressed at block 2014 to enable synchronization of the paired firearms 10. The enabled synchronization function of device 12 may be indicated by indicator 78 providing a solid green indication as shown at block 2016. Enabling the synchronization function may energize the solenoid of valve 36 (see block 2018) and cause the closing of valve 36 when ram 48 is extended to contact or be proximate to the back side of trigger 30. The closing of valve 36 may consequently cause ram 48 to be locked in the extended position and thereby prevent actuation of trigger 30 to the firearm-discharge position.

Block 2020 shows the shooter of the instance device 12 applying force F equal to or exceeding the PPVW on trigger 30. If, at decision block 2022, the shooters of the paired devices 12 are all applying the PPVW on their respective triggers 30, the solenoid of the instant device 12 and of other paired devices 12 may be de-energized substantially simultaneously (see block 2024) to open valves 36 of the paired devices 12 and thereby unlock rams 48 to permit the rearward movement of triggers 30 to their respective firearm-discharge positions. The application of the PPVW by all the shooters of the paired devices 12 will then cause substantially synchronized discharge of the paired firearms 10. If, on the other hand, the shooters of all paired devices 12 are not all applying the PPVW on their respective triggers 30, device 12 may wait for the remaining other shooter(s) to apply the PPVW. This waiting stage of device 12 may be indicated by indicator 78 providing a solid red indication as shown at block 2026. At this stage, paired devices 12 may be monitoring the force F applied to their respective triggers 30 via their respective sensors 56.

After the synchronized discharge of the paired firearms 10 at block 2024, depressing sync button 54 again at decision block 2030 may cause ram 48 to return to the extended position proximate or against the back side of trigger 30 and direct the process to block 2016 of method 2000.

If, at block 2032, power button 72 is pressed after the synchronized discharge of the paired firearms 10, device 12 may be turned OFF. Alternatively, if device 12 is kept ON and the paired devices 12 are still paired (see block 2034), valve 36 of the instant device 12 may remain open by keeping the solenoid de-energized. This state may then be indicated to the shooter by causing indicator 78 to emit alternating flashes of red and blue light as shown at block 2008 until sync button 54 is depressed again at block 2006.

In various embodiments, methods 1000 and 2000 may include preventing the discharge of first firearm 10A when the force F applied to trigger 30 of first firearm 10 is lower than the PPVW used by device 12 of first firearm 10A. Methods 1000 and 2000 may include preventing an actuation of trigger 30 of second firearm 10B to prevent the discharge of second firearm 10B. The forces F applied to triggers 30 of first and second firearms 10A, 10B may be monitored by the respective controllers 38 via the respective sensors 56. Once the forces F applied to triggers 30 of first and second firearms 10A, 10B (and optionally additional paired firearms 10) meet or exceed their respective PPVW, this state of the respective devices 12 may be communicated with each other so that the discharge of first and second firearms 10A, 10B may be permitted substantially simultaneously by the substantially simultaneous opening of respective valves 36 for example.

It is understood that other criteria may be evaluated by controller 38 to facilitated synchronized discharge of firearms 10. For example, another possible predetermined condition that could also be input or programed into controller 38 could be the number of paired devices 12 that are required to meet the PPWV before enabling firing of all the paired firearms 10 substantially simultaneously. For example, if four devices 12 were paired together, it could be programed that only some (e.g., two or three) of the paired devices 12 need to meet the PPWV criterion to enable synchronized discharge of those firearms 10 meeting the PPWV criterion.

In various embodiments, methods 1000 and 2000 may include receiving, at first firearm 10A, a shooter input indicative of a message to be transmitted to a shooter of second firearm 10B. The input may be received via message button 74 (shown in FIG. 2). As explained above, upon receipt of such input, a signal may be transmitted from first firearm 10A to second firearm 10B via respective controllers 38. When the signal is received at second firearm 10B, an indication indicative of the message may be provided to the shooter of second firearm 10B. The state of second firearm 10B may be indicated to the shooter of second firearm 10B using indicator 78 for example. The message to the shooter of second firearm 10B may be provided using the same or other indicator 78. In embodiments where the same indicator 78 is used to indicate the message, the function of indicator 78 may be (e.g., temporarily) overridden to indicate the message.

Figure 16:
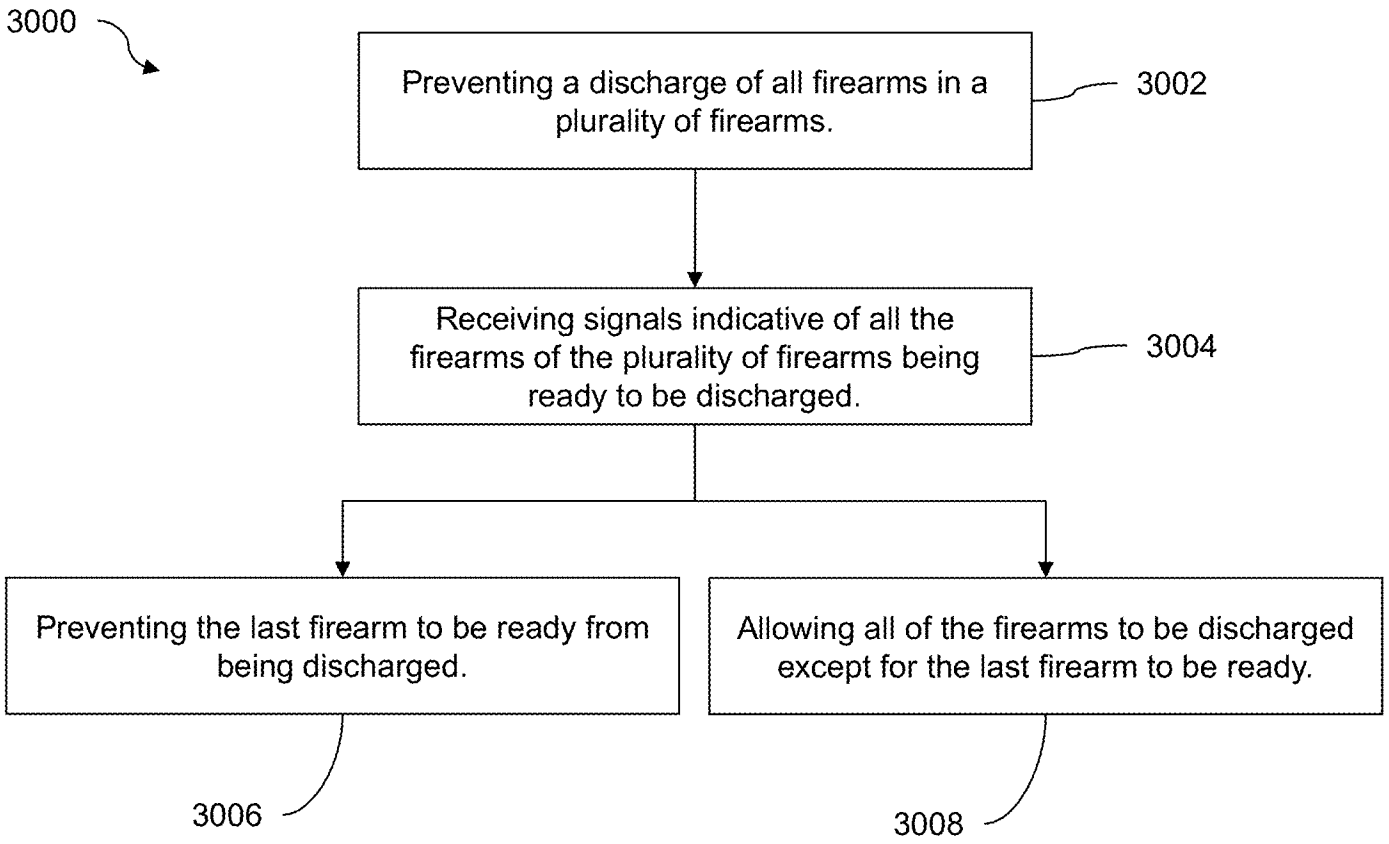
FIG. 16 is a flowchart of another exemplary method for facilitating the synchronized discharge of firearms.

FIG. 16 is a flowchart of another exemplary method 3000 for facilitating a synchronized discharge of two or more firearms 10. Method 3000 may be performed using devices 12, 112 and 212 described herein or using other devices. Aspects of method 3000 may be combined with aspects of methods 1000, 2000 or other methods described herein. Alternatively, method 3000 may be performed independently from methods 1000 and 2000. Method 3000 may appeal to shooting range enthusiasts by incorporating a sense of competition between shooters and promoting a more rapid shooting procedure. In reference to FIG. 16, when a group of three or more shooters are using respective devices 12 for synchronized discharge of their respective firearms 10, the last shooter to be ready to shoot and apply the PPWV on their trigger 30 (i.e., the slowest shooter) may be prevented from discharging their firearm 10 when all other shooters in the group are substantially simultaneously permitted to discharge their firearms 10.

As controllers 38 of respective devices 12 receive signals from other controllers 38 confirming the application of the PPVW by other shooters in the group, one of the controllers 38 may, based on the timing of the signals received or based on a time stamp associated with or part of the signal(s), determine that it's shooter was the last one to apply the PPVW. Accordingly, when all shooters in the group have applied the PPVW, all shooters except for the last shooter to apply the PPVW may be permitted to discharge their firearm 10. In relation to system 12 shown in FIG. 2, this may be achieved by opening valve 36 on all firearms 10 that are permitted to be discharged, and keeping valve 36 closed on the firearm 10 that is prevented from being discharged. Any number of shooters and firearms 10 may be in the group. One or more of the last shooters to apply the PPVW may be prevented from discharging their firearm(s) 10.

Settings associated with this function, such as activating this function and specifying the number of last (i.e., slowest) shooters to be prevented from discharging their firearms 10, may be preprogrammed into controller 38 or may be communicated to controller 38 via an application (app) loaded on another (e.g., portable/mobile) electronic device that is in communication with controller(s) 38 for example.

In reference to FIG. 16, method 3000 may comprise:

preventing a discharge of all firearms 10 in a plurality of firearms 10 (block 3002);

receiving signals indicative of all firearms 10 of the plurality of firearms 10 being ready to be discharged (block 3004), the signals being associated with respective ready times, a last firearm 10 of the plurality of firearms having a latest ready time; and permitting the discharge of all firearms 10 in the plurality of firearms 10 except for the last firearm 10 (see blocks 3006 and 3008).

In some embodiments, the plurality of firearms 10 may include four or more firearms 10.

In some embodiments, method 3000 may comprise monitoring forces applied to respective triggers 30 of each firearm 10 in the plurality of firearms 10. Each firearm 10 in the plurality of firearms 10 may be ready to be discharged when a force applied to trigger 30 of each firearm 10 is equal to or exceeds the PPVW greater than or equal to a TPWV of the respective firearm 10.

FIG. 17 is a table listing exemplary states of device 12 with associated user actions and states of indicator 78. As explained above, indicator 78 (e.g., LED capable of selectively emitting light of different colors) may provide a visual indication to the shooter of the current state of device 12. When device 12 is OFF, indicator 78 may also be OFF. When device 12 is turned ON by pressing power button 72, indicator 78 may provide a solid (i.e., non flashing) purple indication. When sync button 54 is depressed, indicator 78 may emit alternating flashes of red and blue light during the synchronizing function. When the synchronization function is complete and devices 12 of two or more firearms 10 are paired, indicator 78 may provide a solid green indication. When shooter(s) of other firearms has/have reached their respective PPWVs and are waiting for the current shooter to reach his/her PPWV, indicator 78 of the current device 12 may provide a solid yellow indication. On the other hand, when the current shooter has reaches his/her PPWV and is waiting for one or more other shooters to reach their respective PPWVs, indicator 78 of the current device 12 may provide a solid red indication. Immediately after the synchronized discharge of firearms 10, indicator 78 may provide a solid purple indication. The light colors indicated in FIG. 17 are provided as non-limiting examples only and it is understood that other color schemes may be suitable.

In some embodiments, the use of multiple devices 12 on multiple respective firearms 10 may enable simultaneous discharge/firing of the firearms 10 only when the applicable shooters are ready to fire their respective firearms 10. Device 12 may be relatively passive by nature and only have influence on the associate firearm 10 after being powered on and the synchronizing function has been initiated. Device 12 may not itself cause the discharge of firearm 10. Instead, only the shooter applying force F on trigger 30 in the ordinary way may cause firearm 10 to be discharged. Device 12 may disable firearm 10 from being discharged until the programmed one or more predetermined conditions a met.

Device 12 may be turned OFF by any of the shooters at any time, at which point they may operate and fire their respective firearms 10 normally. The use of device 12 may also reduce or eliminate the need for the shooters to communicated with each other while preparing to discharge their firearms 10 toward one or more targets.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

What is claimed is:

1. A kit comprising:

a pistol grip for a firearm, the pistol grip including:

a shell for interfacing with a hand of a shooter;

an actuator for engaging with a movable trigger of a firearm, the actuator configurable between a first configuration that prevents movement of the trigger toward a firearm-discharge position of the trigger, and a second configuration that permits movement of the trigger toward the firearm-discharge position of the trigger, the actuator being housed by the shell;

a sensor configured to generate a signal indicative of a force applied to the trigger by the shooter; and a controller operatively coupled to the sensor and to the actuator, the controller configured to: receive data indicative of one or more states of one or more respective other firearms; and when the force is equal to or exceeds a predetermined pull weight value greater than a trigger pull weight value of the firearm, and the one or more states indicate that the one or more other firearms are ready for discharge, cause the actuator to transition from the first configuration to the second configuration to permit movement of the trigger toward the firearm-discharge position of the trigger; and a trigger guard, a rear end of the trigger guard being slotted to provide a passage for a ram of the actuator.

2. The kit as defined in claim 1, wherein the pistol grip includes one or more user input devices disposed on the shell and operatively coupled to the controller.

3. The kit as defined in claim 1, wherein the actuator includes the ram for engaging with a back side of the trigger.

4. The kit as defined in claim 1, wherein the actuator is a hydraulic actuator.

5. The kit as defined in claim 4, wherein the sensor is configured to sense a pressure of hydraulic fluid interacting with the hydraulic actuator and generate the signal indicative of the force applied to the trigger by the shooter from the pressure of the hydraulic fluid.

6. A method of facilitating a synchronized discharge of firearms, the method comprising:

preventing a discharge of a first firearm by preventing an actuation of a first trigger of the first firearm to a first firearm-discharge position when a discharge of a second firearm is prevented;

monitoring a first force applied to the first trigger of the first firearm; and when the first force applied to the first trigger of the first firearm is equal to or greater than a trigger pull weight value of the first firearm and the discharge of the second firearm is permitted, substantially simultaneously permitting the discharge of the first firearm by permitting the actuation of the first trigger to the first firearm-discharge position.

7. The method as defined in claim 6, comprising preventing the discharge of the first firearm when the first force applied to the first trigger is lower than a first predetermined pull weight value greater than the trigger pull weight value of the first firearm.

8. The method as defined in claim 6, comprising preventing an actuation of a second trigger of the second firearm to a second firearm-discharge position to prevent the discharge of the second firearm.

9. The method as defined in claim 8, comprising monitoring a second force applied to the second trigger of the second firearm.

10. The method as defined in claim 9, wherein:

the discharge of the second firearm is permitted when the second force applied to the second trigger is equal to or exceeds a trigger pull weight value of the second firearm; and the method includes permitting the discharge of the second firearm by permitting the actuation of the second trigger to the second firearm-discharge position of the second trigger.

11. The method as defined in claim 6, comprising preventing the actuation of the first trigger using a hydraulic actuator interacting with the first trigger by preventing a flow of hydraulic fluid out of a chamber of the hydraulic actuator.

12. The method as defined in claim 11, comprising permitting the actuation of the first trigger by allowing the flow of hydraulic fluid out of the chamber of the hydraulic actuator.

13. The method as defined in claim 12, wherein before preventing the discharge of the first firearm, the method comprises manually urging the hydraulic fluid into the chamber of the hydraulic actuator.

14. The method as defined in claim 6, comprising:

receiving, at the first firearm, a shooter input indicative of a message to be transmitted to a shooter of the second firearm;

transmitting a signal from the first firearm to the second firearm; and when the signal is received at the second firearm, providing an indication indicative of the message to the shooter of the second firearm.

15. The method as defined in claim 14, comprising:

indicating a state of the second firearm to the shooter of the second firearm using an indicator; and providing, using the indicator, the indication indicative of the message to the shooter of the second firearm.

16. The method as defined in claim 6, wherein the first and second firearms are part of a plurality of firearms including more than two firearms, and the method comprises:

preventing a discharge of all of the firearms in the plurality of firearms;

receiving signals indicative of all the firearms of the plurality of firearms being ready to be discharged, the signals being associated with respective ready times, a last firearm of the plurality of firearms having a latest ready time; and permitting the discharge of all firearms in the plurality of firearms except for the last firearm.

17. The method as defined in claim 16, wherein the plurality of firearms includes four or more firearms.

18. The method as defined in claim 16, comprising monitoring forces applied to respective triggers of each firearm in the plurality of firearms, wherein each firearm in the plurality of firearms is ready to be discharged when a force applied to the trigger of each firearm is equal to or exceeds a predetermined pull weight value greater than a trigger pull weight value of the respective firearm.

* * * * *